US011475820B2

(12) United States Patent
Xu et al.

(10) Patent No.: US 11,475,820 B2
(45) **Date of Patent: *Oct. 18, 2022**

(54) ACTIVE MATRIX ORGANIC LIGHT-EMITTING DIODE DISPLAY DEVICE AND METHOD FOR DRIVING THE SAME

(71) Applicant: Chihao Xu, Saarbruecken (DE)

(72) Inventors: Chihao Xu, Saarbruecken (DE); Pascal Volkert, Kirkel-Limbach (DE)

(73) Assignee: Chihao Xu, Saarbruecken (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/241,452

(22) Filed: Apr. 27, 2021

(65) Prior Publication Data

US 2021/0287589 A1 Sep. 16, 2021

Related U.S. Application Data

(60) Continuation of application No. 16/669,944, filed on Oct. 31, 2019, now Pat. No. 11,024,214, which is a (Continued)

(51) Int. Cl.

| | |
|---|---|
| ***G09G 3/20*** | (2006.01) |
| ***G09G 3/3233*** | (2016.01) |
| ***G09G 5/06*** | (2006.01) |
| ***G09G 3/3216*** | (2016.01) |
| ***G09G 3/3225*** | (2016.01) |

(52) U.S. Cl.

CPC ..... *G09G 3/2022* (2013.01); *G09G 3/3216* (2013.01); *G09G 3/3225* (2013.01); *G09G 3/3233* (2013.01); *G09G 5/06* (2013.01); *G09G 2300/0842* (2013.01); *G09G 2310/027* (2013.01); *G09G 2320/0233* (2013.01); *G09G 2320/0266* (2013.01); *G09G 2320/0295* (2013.01); *G09G 2320/041* (2013.01); *G09G 2320/043* (2013.01); *G09G 2330/04* (2013.01); *G09G 2360/16* (2013.01)

(58) Field of Classification Search

CPC .. G09G 3/2022; G09G 3/3216; G09G 3/3233; G09G 3/2025; G09G 5/06; G09G 2310/027; G09G 2320/0233; G09G 2320/043; G09G 2330/04

See application file for complete search history.

(56) References Cited

U.S. PATENT DOCUMENTS 10,497,300 B2 * 12/2019 Xu ..... G09G 3/3216
2003/0011553 A1 1/2003 Ozaki
(Continued)

*Primary Examiner* — Stephen G Sherman
(74) *Attorney, Agent, or Firm* — Maier & Maier, PLLC

(57) ABSTRACT

A method for driving an active matrix organic light-emitting diode (AMOLED) display. The method may be used to digitally drive the AMOLED display in a way that limits the susceptibility of the AMOLED display to certain problems arising out of digital driving techniques, such as image sticking or low display lifetimes. The method involves generating compensation factors corresponding to each pixel of the display and using those compensation factors to control the illumination of the display. The aspects of the method that incorporate the operation point for generating a compensation factor may also be applied to analog driving of AMOLED displays.

17 Claims, 11 Drawing Sheets

Related U.S. Application Data division of application No. 16/130,169, filed on Sep. 13, 2018, now Pat. No. 10,497,300, which is a division of application No. 15/164,368, filed on May 25, 2016, now Pat. No. 10,115,332.

(56) References Cited

U.S. PATENT DOCUMENTS

| | | | |
|---|---|---|---|
| 2005/0030305 | A1 | 2/2005 | Brown et al. |
| 2006/0017669 | A1 | 1/2006 | Cok et al. |
| 2006/0061529 | A1 | 3/2006 | Kim |
| 2006/0221015 | A1 | 10/2006 | Shirasaki et al. |
| 2009/0309902 | A1 | 12/2009 | Weitbruch et al. |
| 2011/0292022 | A1 | 12/2011 | Lee et al. |
| 2012/0009506 | A1 | 1/2012 | Tanahashi et al. |
| 2015/0062202 | A1 | 3/2015 | Lu |
| 2015/0379940 | A1 | 12/2015 | Kaisha |
| 2016/0267834 | A1 | 9/2016 | Zheng et al. |

* cited by examiner

ACTIVE MATRIX ORGANIC LIGHT-EMITTING DIODE DISPLAY DEVICE AND METHOD FOR DRIVING THE SAME

CROSS-REFERENCE TO RELATED APPLICATIONS

This is a continuation of U.S. patent application Ser. No. 16/669,944, filed on Oct. 31, 2019, which is a divisional of U.S. patent application Ser. No. 16/130,169, filed on Sep. 13, 2018, now U.S. patent Ser. No. 10/497,300, issued on Dec. 3, 2019, which is a divisional of U.S. patent application Ser. No. 15/164,368, filed on May 25, 2016, now U.S. Pat. No. 10,115,332, issued on Oct. 30, 2018, the entire contents of which are incorporated herein by reference.

BACKGROUND

AMOLED (active-matrix organic light-emitting diode) displays have seen increased popularity in recent years, because of reduced costs and because of certain advantages demonstrated by AMOLED screens, such as high contrast and low power consumption. However, AMOLED display technology is still relatively immature.

One area of AMOLED technology that is still underdeveloped relates to the methods and systems used to digitally drive AMOLED displays. More efficient digital driving schema for AMOLED displays may allow for higher production yields and significantly reduced power consumption for AMOLED displays. Other problems, such as possible visual artifacts like false contours, image sticking, and the like, must also be avoided by a digital driving scheme. Since the digital driving schema of plasma display panels (PDP) share certain similarities with those of AMOLED displays, certain inspiration can be taken from that field, and some solutions to the problems of AMOLED displays like dynamic false contours may be solved by adapting known methods for PDP. However, there are specific problems related to AMOLEDs which need to be solved. In addition, the specific electro-optical characteristics of AMOLED require different solutions to the problems than are required by PDP.

SUMMARY

Several methods for driving an active matrix organic light-emitting diode (AMOLED) display may be disclosed. The AMOLED display may include a plurality of organic light-emitting diodes (OLEDs) arranged in a plurality of rows and a plurality of columns; a plurality of pixel circuits each configured to drive an OLED, and arranged in a plurality of rows and a plurality of columns; a scan line for selecting the pixel circuits of each row of pixel circuits and a data line for controlling the pixel circuits of each column of pixel circuits; and a plurality of supply lines connected to the anodes and cathodes of the AMOLED pixels.

A first exemplary method may include: with a processor, accessing one or more predefined lookup tables, decomposing image data into a plurality of binary subframes according to the one or more predefined lookup tables, and generating a binary subframe signal from a binary subframe in the plurality of binary subframes; activating, on the AMOLED display, an organic light emitting diode, based on a scan signal on the scan line and the generated binary subframe signal applied on the data line, wherein the step of activating an organic light emitting diode comprises allowing or blocking a current to flow via the supply lines and through the organic light emitting diode; and connecting the supply lines to a voltage source for an on-duration of the organic light emitting diode, wherein the on-duration correlates to a predefined luminance factor for the binary subframe in the plurality of binary subframes, and wherein the on-duration is dependent on the number of activated pixels of the binary subframe in the plurality of binary subframes.

Another exemplary method may include: measuring, with an electronic unit like a current sensor, an electrical property of one or more OLEDs, each of the one or more OLEDs being a component of an OLED pixel, each of the OLED pixels having an IV-characteristic value and a current efficiency value; calculating, with a processor, a compensation factor against the drift of the IV-characteristic and the drift of the current efficiency of one or more OLED pixels based on the electrical values measured; adjusting, based on the compensation factor of the one or more OLED pixels, one or more pixel gray values of the one or more OLED pixels; with a processor, accessing one or more predefined lookup tables, decomposing the adjusted pixel gray values of an image into a plurality of binary subframes according to the one or more predefined look-up tables, and generating a binary subframe signal from a binary subframe in the plurality of binary subframes; activating an OLED pixel, based on a scan signal on the scan line and the generated binary subframe signal applied on the data line, wherein the step of activating the OLED pixel comprises allowing or blocking a current to flow via the supply lines through an organic light emitting diode of the OLED pixel; and connecting the supply lines to a voltage source for an on-duration of the organic light emitting diode of the OLED pixel, wherein the on-duration correlates to a predefined luminance factor for the binary subframe in the plurality of binary subframes.

Another exemplary method may include: simulating, with a processor, the pixel current distribution of the AMOLED display based on a dependence of at least one of an internal OLED capacitance and resistance of at least one or more of the supply lines, the columns and the rows of the AMOLED display; measuring, with an electronic unit like a current sensor, an electrical property of one or more OLED pixels, each of the OLED pixels having an IV-characteristic value and a current efficiency value; calculating, with a processor, a compensation factor against the drift of the IV-characteristic and a compensation factor against the drift of the current efficiency of one or more OLED pixels based on the electrical values measured; simulating, with a processor, the I-V drift of OLED pixels in the simulation of pixel current distribution; calculating, with a processor, one or more subimages by considering the drift of the current efficiency of a pixel; successively decomposing the image data into a plurality of binary subframes, and generating a binary subframe signal from a binary subframe in the plurality of binary subframes; activating an organic light emitting diode, based on a scan signal on the scan line and the generated binary subframe signal applied on the data line, allowing or blocking a current to flow via the supply lines through the organic light emitting diode; and connecting the supply lines to a voltage source for an on-duration on-duration of the organic light emitting diode, wherein the on-duration correlates to a predefined luminance factor for the binary subframe in the plurality of binary subframes.

Another exemplary method may include: measuring, with an electronic unit like a current sensor, an electrical property of one or more OLEDs, each of the one or more OLEDs being a component of an OLED pixel, each of the OLED pixels having a current efficiency value; calculating, with a processor, a compensation factor against the drift of the current efficiency of the one or more OLED pixels based on the electrical properties measured; adjusting, based on the compensation factor of the one or more OLED pixels, one or more pixel gray values of the one or more OLED pixels, wherein the adjustment of the one or more pixel gray values further depends on an operation point of an OLED in the OLED pixel; applying a data signal to the pixel circuit based on the adjusted pixel gray value; and wherein the adjusted pixel gray value of the OLED pixel is generated based on the amplitude of the current fed to the pixel circuit.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which:

Exemplary FIG. 1 may show an exemplary embodiment of an AMOLED matrix equivalent circuit.

Figure 2:
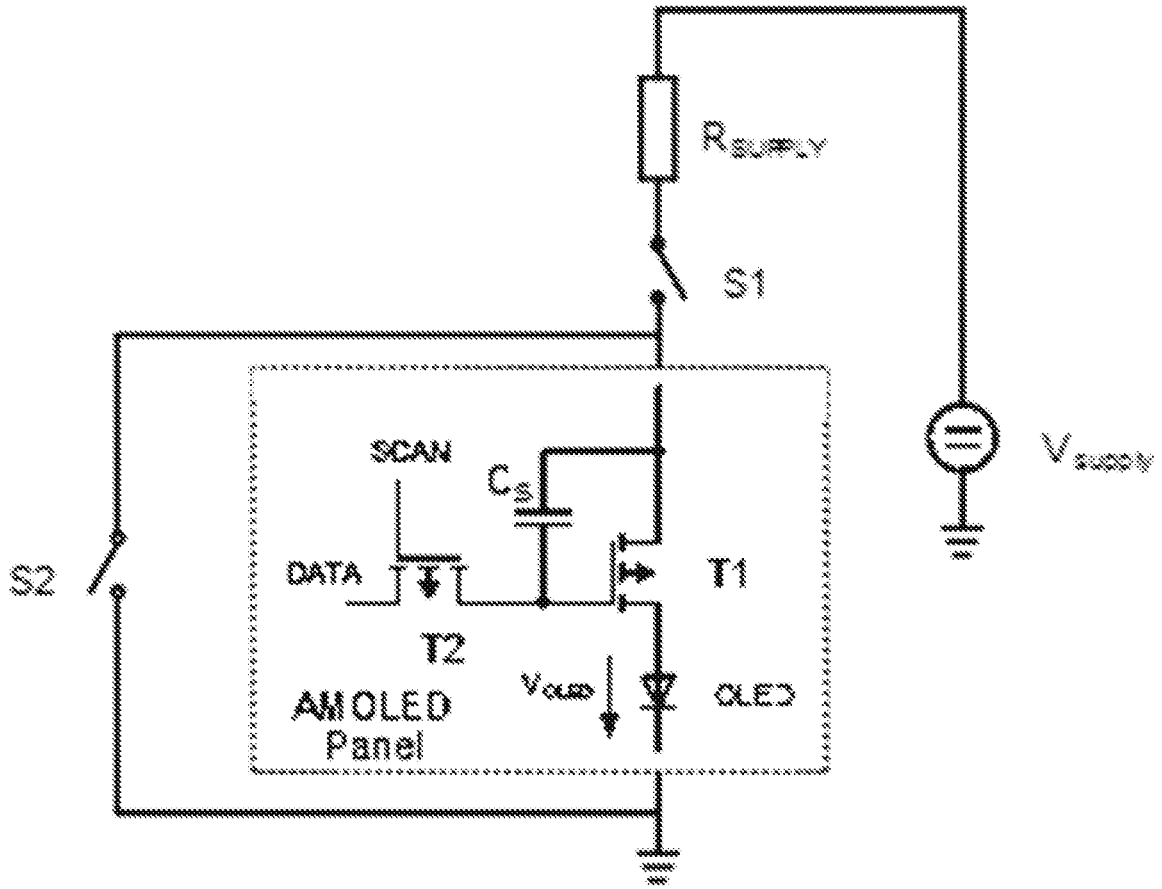

Exemplary FIG. 2 may show an alternative exemplary embodiment of an AMOLED matrix equivalent circuit.

Figure 3:
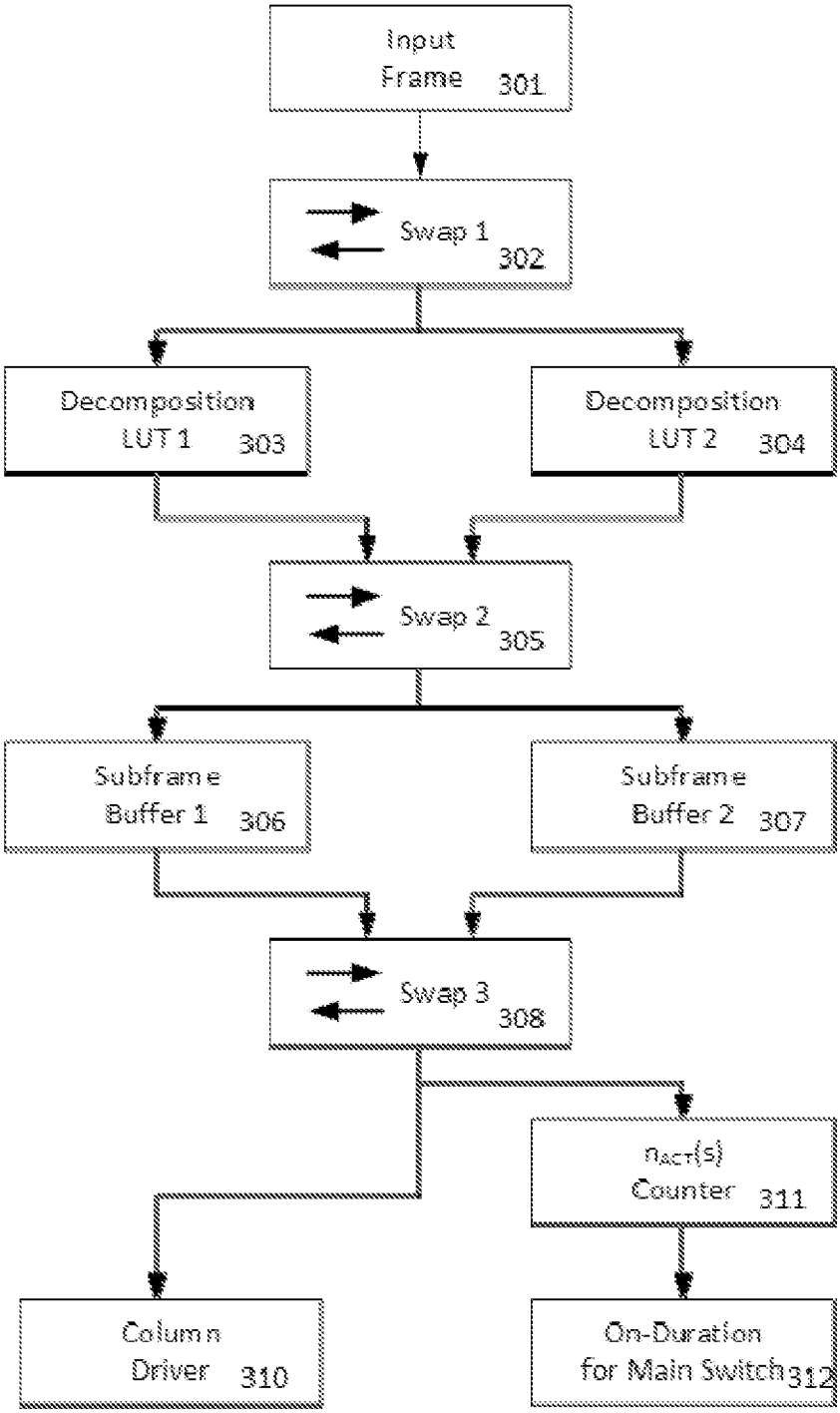

Exemplary FIG. 3 may show an exemplary flowchart depicting a process by which control signals for driving an AMOLED display may be generated.

Figure 4:
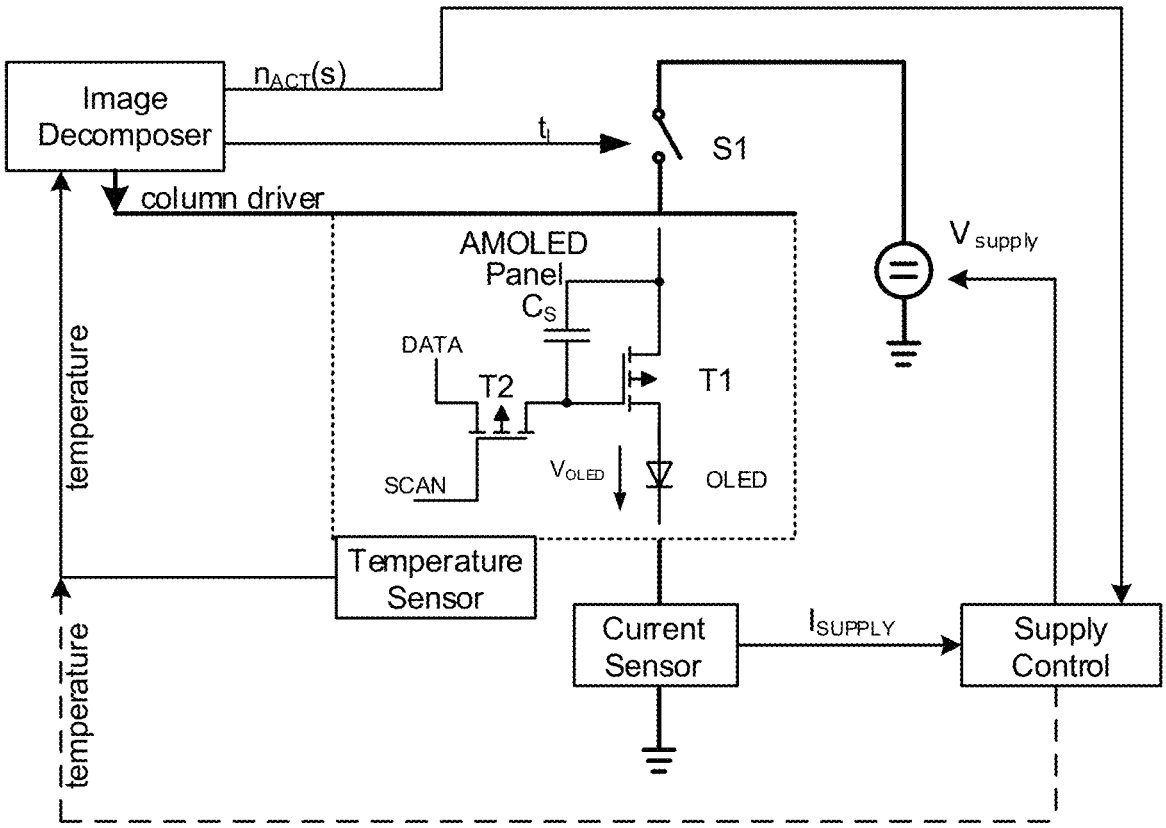

Exemplary FIG. 4 may show an exemplary embodiment of a feedback control loop that may be used to adapt power supply voltage.

Figure 5:
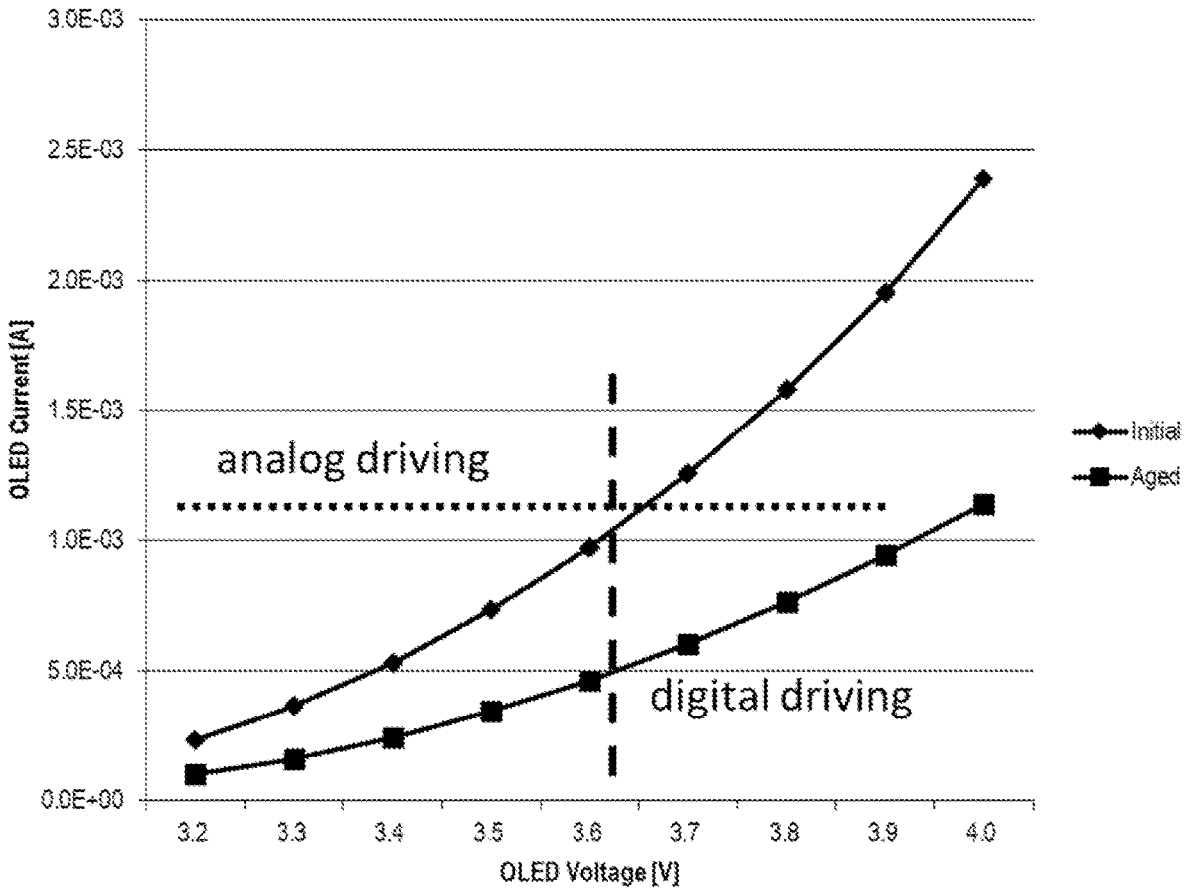

Exemplary FIG. 5 may show the I-V curves of an exemplary OLED at two different stages.

Figure 6:
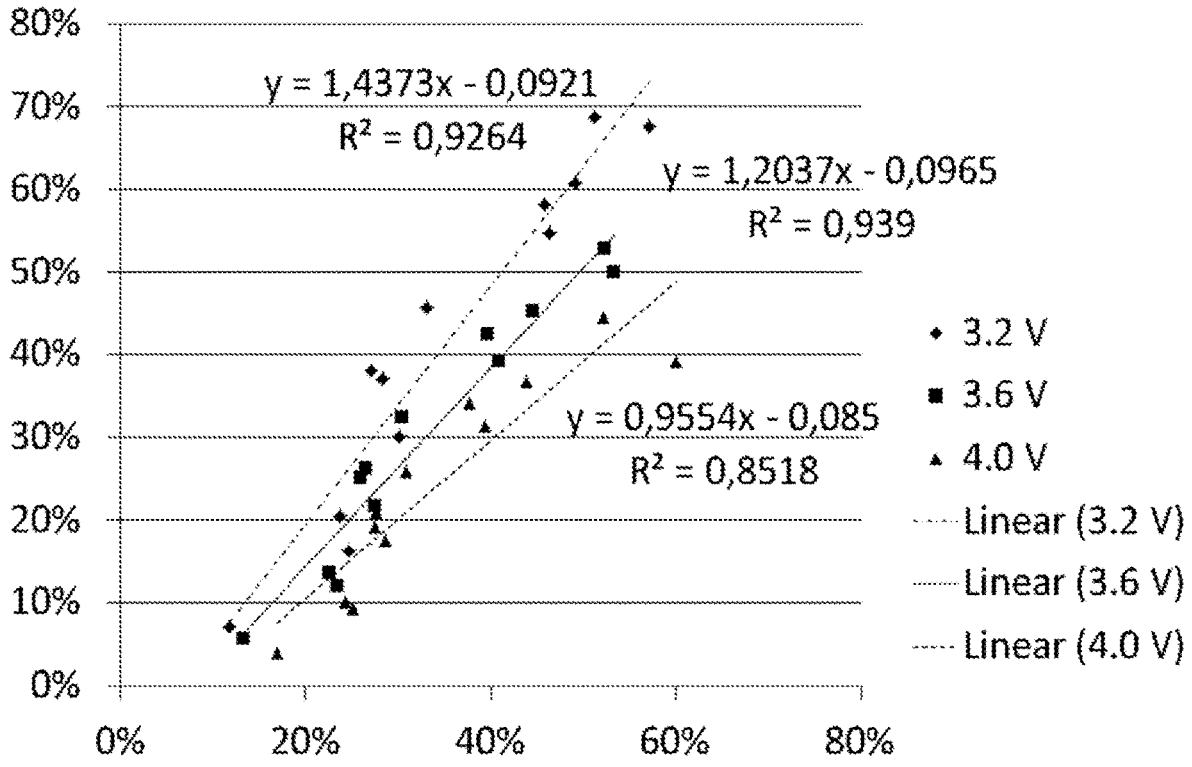

Exemplary FIG. 6 may show an exemplary plot of the normalized current efficiency change (y-axis) versus normalized current change (x-axis) of an exemplary OLED device at various aging states.

Figure 7:
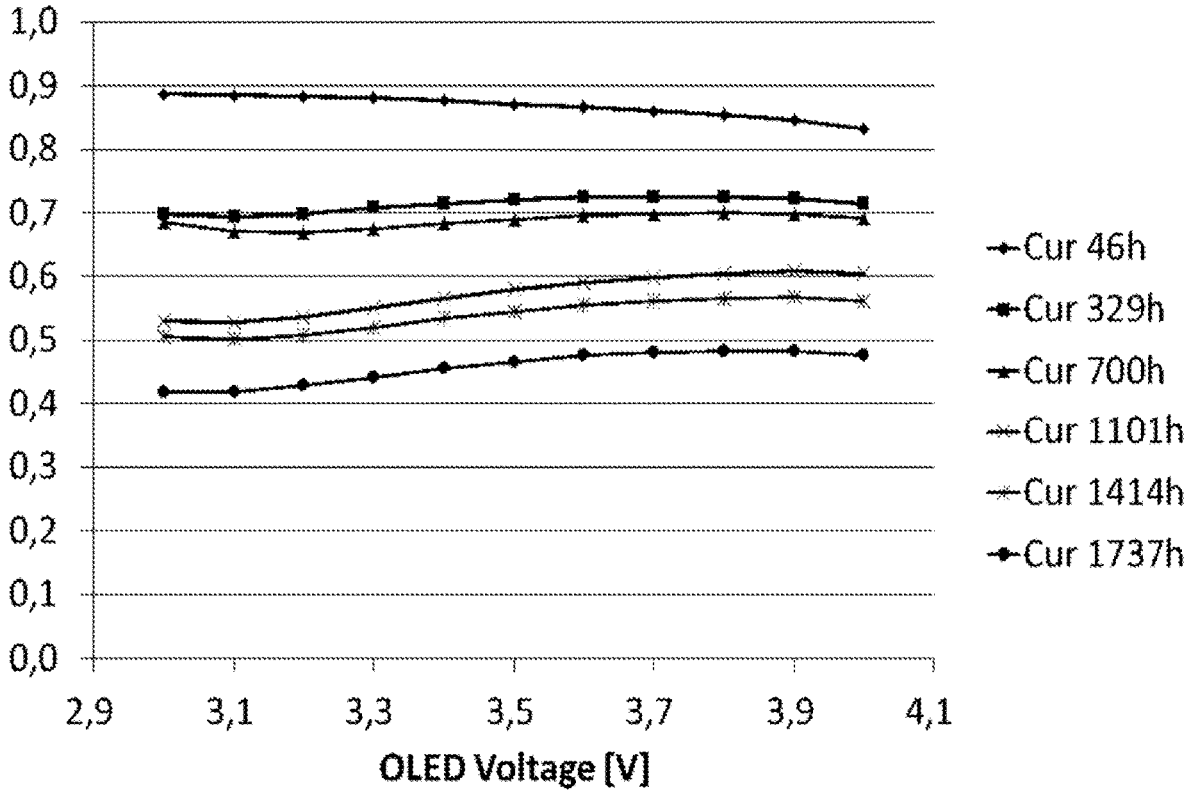

Exemplary FIG. 7 may show a plot of the normalized current of an exemplary OLED device at a variety of aging states.

Figure 8:
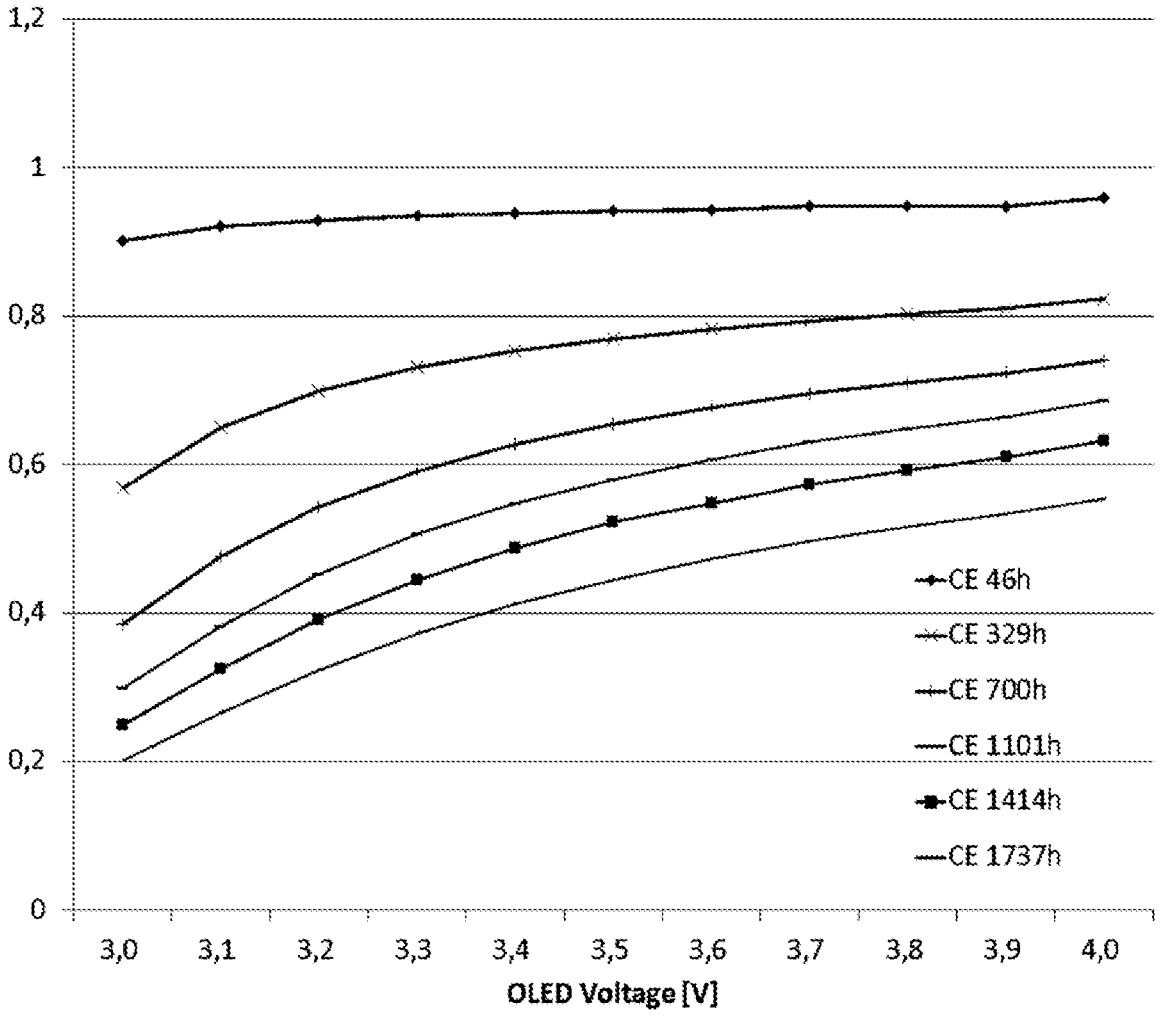

Exemplary FIG. 8 may show a plot of the normalized current efficiency of an exemplary OLED device at various aging states.

Figure 9:
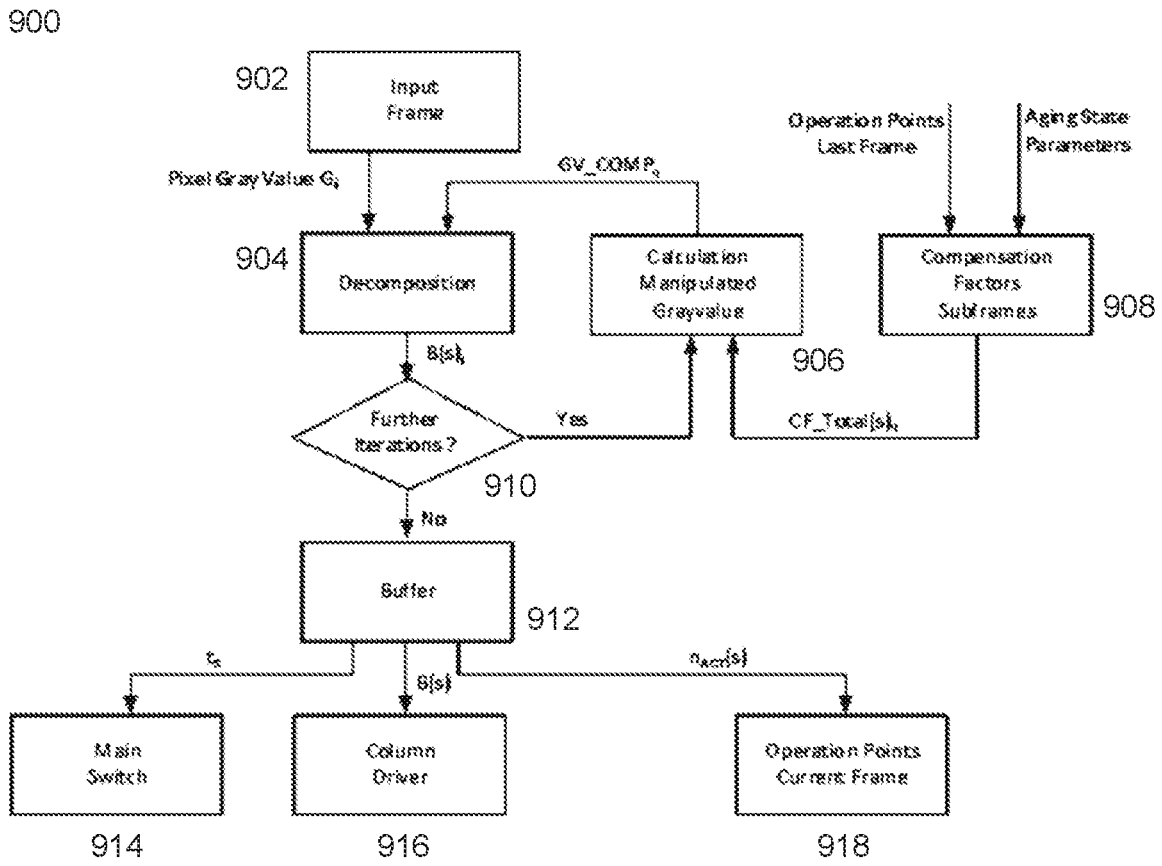

Exemplary FIG. 9 may show an exemplary flowchart depicting a method by which an image may be decomposed.

Figure 10:
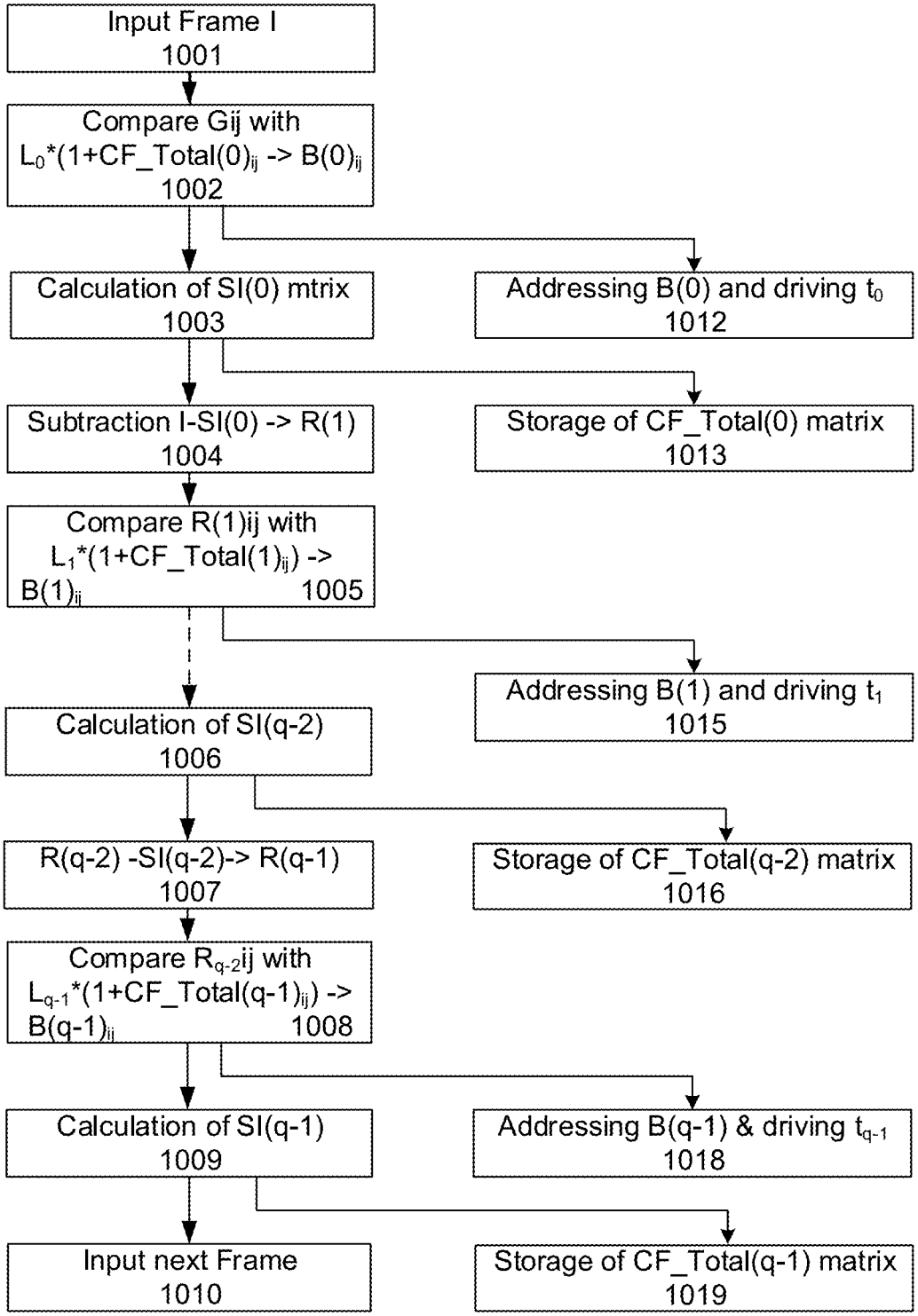

Exemplary FIG. 10 may show a flowchart of a method for generating a sequence of binary-value subframes used for driving an AMOLED display from a gray-value image.

Figure 11:
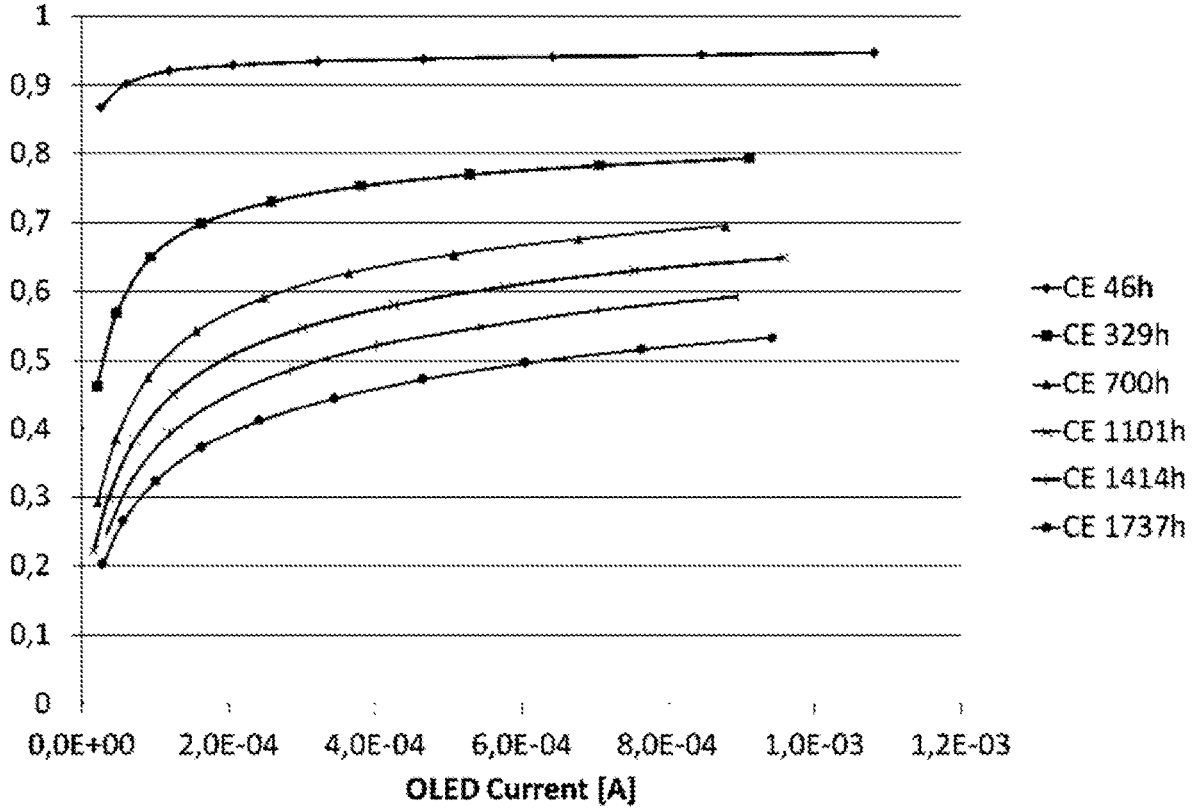

Exemplary FIG. 11 may show a plot of the normalized current efficiency of an exemplary OLED device at various aging states.

DETAILED DESCRIPTION OF THE EMBODIMENTS

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

Further, many embodiments are described in terms of sequences of actions to be performed by, for example, elements of a computing device. It will be recognized that various actions described herein can be performed by specific circuits (e.g., application specific integrated circuits (ASICs)), by program instructions being executed by one or more processors, or by a combination of both. Additionally, these sequence of actions described herein can be considered to be embodied entirely within any form of computer readable storage medium having stored therein a corresponding set of computer instructions that upon execution would cause an associated processor to perform the functionality described herein. Thus, the various aspects of the invention may be embodied in a number of different forms, all of which have been contemplated to be within the scope of the claimed subject matter. In addition, for each of the embodiments described herein, the corresponding form of any such embodiments may be described herein as, for example, "logic configured to" perform the described action.

Figure 1:
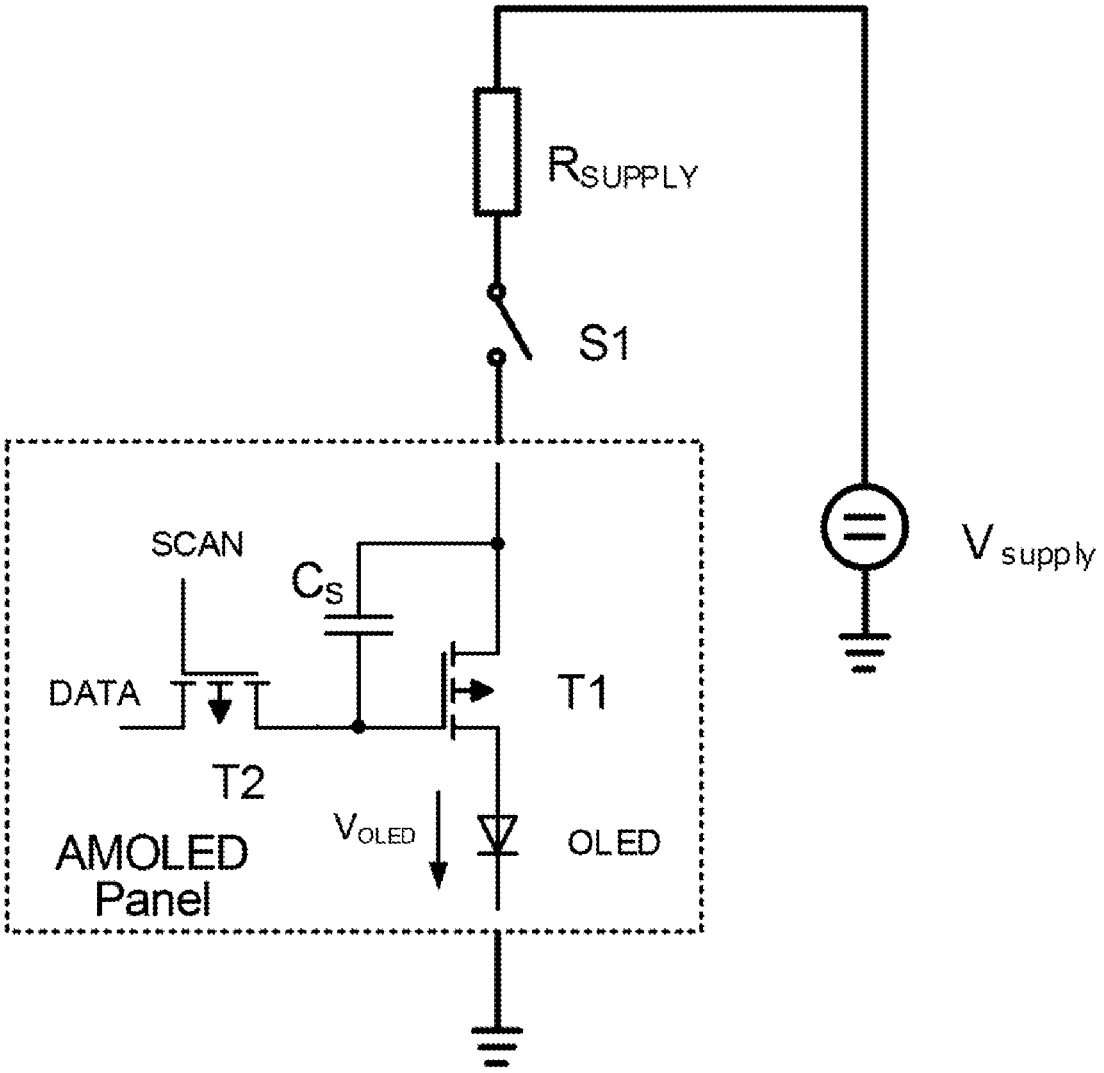

Referring first to exemplary FIG. 1, FIG. 1 displays an exemplary embodiment of an AMOLED matrix equivalent circuit, as understood in the art. The 2T1C (2 transistors 1 capacitor) pixel circuit displayed in FIG. 1 may be a basic pixel circuit for AMOLED. According to an exemplary embodiment, the SCAN line may be controlled by a row driver IC. If the row driver is active, a particular row may be selected/addressed, and the transistor T2 may be turned on. The DATA line may be controlled by a column driver IC which applies a signal according to the image data. According to an exemplary embodiment, when the AMOLED circuit is digitally driven, this signal may be a binary signal, either high or low. This signal may be stored in the capacitor Cs, when other rows are selected and the transistor T2 is turned off. According to an exemplary embodiment, when the AMOLED circuit is digitally driven, Cs may even be omitted, as there are further parasitic capacitances existing in the pixel circuit and the data signal is either high or low, making it somewhat resistant to noise for example, it may be able to tolerate discharging of the parasitic capacitances to a certain extent e.g. in a particular voltage range.

In the circuit diagram of FIG. 1, the resistances of the row lines and column lines are neglected. It may be assumed that each OLED pixel receives the same or substantially the same voltage, if the OLED diode is activated by the driver transistor T1 which is operated as a switch with just an on or off state. This may allow the assumption that the OLED current is identical in each of the activated pixels, or that the pixel current distribution of a binary subframe is uniform. All the activated AMOLED pixels (DATA signal=ACTIVE) may be considered as a parallel circuit of identical pixels and summed up to one OLED diode, as shown in the electrical equivalent circuit of FIG. 1.

In reality, there may of course be differences between each AMOLED pixel. There are still low voltage drop across a column/row line. The driver transistor will cause a low voltage drop which may vary. Also, each OLED diode is individual, and not absolutely identical to other OLED diodes. Attributes such as the temperature of each AMOLED pixel may be different. However, since, in most operating conditions, the OLED diodes will usually just smoothly vary from a pixel to the next, the temperature on the display will just show a smooth gradient, and the voltage across adjacent OLED diodes may be substantially identical, the luminance distribution may be perceived as uniform. Thus, the representation of the model in FIG. 1, specifically that the attributes of one OLED can be used to model every activated OLED, may be reasonable.

For RGB OLEDs it may make sense that three different power supply voltages are connected for the different OLED types. Thus, the model in FIG. 1 is still applicable and reasonable. Three independent circuits having approximately the same circuit configuration as is shown in FIG. 1, with each having their own power supply and switch (S1), may cover such an embodiment.

In this description, the number of activated pixels of the s-th subframe may be denoted as nACT(s). The voltage across an activated OLED diode is not the voltage of the power supply ($V_{SUPPLY}$ in FIG. 1) and depends on the content of the binary subframe, or more specifically the number of activated pixels nACT(s), as the supply line, the main switch S1 and the supply itself each have internal resistance. These resistances are summed up to the resistor $R_{SUPPLY}$ in FIG. 1. The resistance $R_{SUPPLY}$ shall not be neglected, as the current flowing through it is relatively high. It is the total display current and typically thousand times higher than the current through a row line or column line.

Thus, even though a pixel current does still depend on the image content, the model in FIG. 1 simplifies the calculation/simulation of the pixel current, since every pixel current is assumed to be identical. The following equations are valid.

$$I_{OLED}=f_{OLED}(V_{OLED}) \tag{1}$$

$$V_{OLED}=V_{SUPPLY}-n_{ACT}(s)\cdot I_{OLED}-R_{SUPPLY} \tag{2}$$

The OLED current $I_{OLED}$ is a function of the voltage across the OLED pixel, as equation 1 shows, and may be correlated to the luminance of this pixel. This function may be based on the physical characteristics of the OLED diode and may contain the influence of the resistance of the driver transistor T1 like the intrinsic resistance of the OLED diode. The supply voltage $V_{SUPPLY}$ is constant and its height may reflect the brightness of the display set (e.g. 300 "nits," or candelas per square meter). The resistance $R_{SUPPLY}$ may also be constant. $n_{ACT}(s)$ is the number of the activated pixels of the s-th subframe and effectively the average value of the lighting area over the whole display area. Thus the OLED pixel current of a subframe given is a function of $n_{ACT}(s)$:

$$I_{OLED}=g_{FRAME}(n_{ACT}(s)) \tag{3}$$

This function may be determined by computer simulation, electrical/optical measurement and/or estimation.

Based on the model in FIG. 1, the image decomposition is now much simpler, as the compensation of non-uniform luminance distribution within a subframe is not required. The gray value of a pixel (GVij) may be decomposed into a binary series:

$$GV_{ij}=\Sigma_{s=0}^{p-1}B(s)_{ij}\cdot 2^s \tag{4}$$

In Equation 4, B(s)ij may be a binary value, either zero or one and is to be implemented by the driver transistor T1 (off/on) of the pixel ij for the subframe s. The number of bits of the full-scale gray value may be represented as p. Other series than the $2^S$ series are possible and may help to avoid possible visual artifacts like dynamic false contours due to human perception. Equation 4 can be transferred to a generic form:

$$GV_{ij}=\Sigma_{s=0}^{q-1}(s)_{ij}\cdot L_s \tag{5}$$

In this equation, $L_S$ is the luminance factor for the binary subframe s and may be correlated to the on-duration of the switch S1 for this subframe. According to an exemplary embodiment, the number of subframes q may be higher than p. The following relations may apply:

$$q\geq p \tag{6}$$

$$L_{s+1}\leq 2\cdot L_s \tag{7}$$

$$\Sigma_{s=0}^{q-1}L_s\geq 2^p-1 \tag{8}$$

According to an exemplary embodiment, a higher q number may allow more ways to effectively suppress possible visual artifacts; however, on the other hand, a higher q number may require more addressing time and may reduce the frame rate. Thus, according to an exemplary embodiment, a number q may be selected such that it is not be significantly higher than the number p. For example, for 12 bits gray scale in the linear domain, the number q may be 15.

According to an exemplary embodiment, the ratio between two adjacent luminance factors may be equal or below 2 in order to map every possible gray value. The sum of every luminance factor has to exceed the full-scale gray value, represented in Equation 8 as $2^p-1$.

If the number of subframes (q) is higher than p, this may allow for redundancy in the mapping of gray values. This means that there are several combinations that may be used to build up a gray value. For example, for an 8 bit gray scale, one exemplary embodiment with 10 luminance factors may utilize the following scale values: 102, 64, 40, 25, 16, 10, 6, 3, 2, 1. For mapping the number 211, several combinations are possible. Below are two possible decompositions:

211=1*102+1*64+1*40+0*25+0*16+0*10+0*6+
1*3+1*2+0*1

211=1*102+1*64+0*40+1*25+0*16+1*10+1*6+
1*3+0*2+1*1

For the first decomposition, the output is 1110000110, and for the second one, 1101011101. Further decompositions are possible. For most gray values, there may be several possible solutions. As such, according to an exemplary embodiment, a decomposition LUT (lookup table) for the 256 input gray values may be arranged according to a certain objective like minimization of Hamming distance.

Thus, the decomposition of the gray value of a pixel can vary from pixel to pixel and/or from frame to frame. Several sets of luminance factors as well as several look up tables may be predefined and used to decompose a gray value. These methods may belong to well-known methods in PDP and are not the scope of this invention and will therefore not be described in more detail.

An image I with a resolution of m columns and n rows may be decomposed into the following series of data values:

$$I_{m\times n}=\Sigma_{s=0}^{q-1}B(s)_{m\times n}\cdot L_s \tag{9}$$

In Equation 9, B(s) is a binary matrix with m columns and n rows and represents the subframe s. Each element is either zero or one. During the addressing of the subframe, the driver transistor (T1 in FIG. 1) is turned on for one (activated) and turned off for zero.

The luminance factor $L_S$ may be proportional to a physical brightness and may be proportional to the OLED pixel current and the on-duration ($t_s$) of the main switch (S1 in FIG. 1) for the subframe. This may be represented in Equation 10:

$$L_s\sim I_{OLED}\cdot t_s\cdot\eta \tag{10}$$

In Equation 10, η is the current efficiency with the unit Cd/A. While the luminance factor $L_S$ may be predefined, the pixel current $I_{OLED}$ may depend on the content of the subframe B(s), as Equation 3 shows. If just a few pixels are activated, the voltage across OLED $V_{OLED}$ may be high and close to the supply voltage $V_{SUPPLY}$, as Equation 2 shows. Thus, $I_{OLED}$ is in this case high. If many or the most pixels are activated, $V_{OLED}$ may be significantly lower than $V_{SUPPLY}$. Thus, $I_{OLED}$ is in this case significantly lower. In order to accurately meet $L_S$, $t_S$ has to be adjusted; $t_S$ may depend on the following:

$$t_s \sim \frac{L_s}{I_{OLED} \cdot \eta} = \frac{L_s}{g_{FRAME}(n_{ACT}(s)) \cdot \eta(n_{ACT}(s))} \tag{11}$$

$$t_s = TON_s \cdot [1 + h_{ON}(n_{ACT}(s))] \tag{12}$$

As digital driving is PWM-like, the operation point (Voled) may be in a relatively narrow range, in contrast to analog driving. The current efficiency η of an OLED may still slightly vary. In Equation 11, the dependence of $I_{OLED}$ on the number of activated pixels as well the dependence of the current efficiency on the number of activated pixels are therefore considered (Equation 3 and Equation 10). Since the $n_{ACT}(s)$ value is the only input, $t_S$ is still a simple one-dimensional function. This equation may be transferred to Equation 12, where TONs may be the on-duration for the case in which just one pixel is activated. $I_{OLED}$ is in this case at its maximum. The correction factor $h_{ON}(n_{ACT}(s))$ is zero. The maximum $h_{ON}(n_{ACT}(s))$ value is for the case wherein every pixel of the subframe is activated, so that $I_{OLED}$ is minimum. Thus, the on-duration of the main switch S1 depends on the number of the activated pixels or the content of the subframe in order to accurately meet the luminance factor $L_S$.

TONs can be predetermined in dependence on the luminance factor $L_S$, the supply voltage $V_{SUPPLY}$ which may be correlated to the display brightness of the panel (e.g. 300 nits) and the electro-optical properties of the AMOLED pixel. The function for the correction factor $h_{ON}(n_{ACT}(s))$ may be determined by computer simulation, electrical/optical measurement and/or estimation. It can be stored as a lookup table in an electronic unit for controlling the AMOLED displays. The $n_{ACT}(s)$ value can be very high, e.g. in the range of millions or even 10 millions. The size of the look up table may be much lower, as the maximum $h_{ON}(n_{ACT}(s))$ may be in 50% range. 10 bits resolution may suffice and allow an accuracy of 0.05%. This way, a smooth and monotone transition of gray value may be assured.

For driving the s-th subframe, a period of TONs*[1+$h_{ON}$(N*M)] may be reserved for the activation of the main switch S1, where N*M stands for the number of pixels of the display. This period is for the case wherein every, or nearly every, pixel of the subframe is on. If the share of the on-pixels is substantially below 100%, the real on-duration $t_S$ is shorter which can of course be realized within the period TONs*[1+$h_{ON}$(N*M)].

Equation 12 is a DC consideration. The capacitances of the OLED pixels as well as the interconnect capacitance may alter the real luminance. For high luminance factors, the deviation may be negligible. For low luminance factors, the deviation may be significant.

Referring now to exemplary FIG. 2, FIG. 2 displays an alternative exemplary embodiment of an AMOLED matrix equivalent circuit. In order to reduce the possible deviation caused by the capacitances and to more accurately control the pixel luminance, a second switch may be inserted, shown in FIG. 2 as S2. S2 may have an alternate state to the main switch S1; that is, if S1 is turned on, S2 may be turned off. The capacitances of the AMOLED panel may be charged and current may flow through the activated OLED pixels emitting light. If S1 is off, S2 is turned on and discharges the capacitances of the AMOLED panel including that of the OLED diodes. This way, the charge stored in the capacitances after the on phase of the switch S1 cannot substantially generate any light.

Charging of the capacitances, when S1 is turned on, may start from a defined state, e.g. zero volts. However, the charging of the capacitances may still alter Equation 10. An effective method is to set up a look up function/table to consider the capacitances. The on-duration of the subframe s may then be:

$$t_S = t_Cap_S(n_{ACT}(s)) \tag{13}$$

The number of subframes may be limited to a particular value, e.g. 15. Accordingly, a similar number of lookup tables, for example 15 LUTs, for $t_S$ may be applied. According to an exemplary embodiment, these may be applied in the form of ICs in order to provide cost reduction; for example, a modern IC process may be able to apply them at a modest cost. Since the deviation for a large $L_S$ may be low, few LUTs for the lowest $t_S$'s may be needed, while for the larger $L_S$'s just one LUT may suffice. For different $L_S$, the accordant $t_S$ value may be gained from $t_0 * L_S / L_0$, wherein $L_0$ is the highest luminance factor and $t_0$ is determined from the LUT $t_Cap_0$ in dependence of $n_{ACT}(s)$.

A simpler, but less accurate method is to calculate the values of TONs in an analytic form, which may be derived from the capacitances and the operation voltage. It may also be determined by a combination of analytical calculation and LUTs. $t_S$ may then be calculated according to Equation 12.

Turning now to exemplary FIG. 3, FIG. 3 shows an exemplary flowchart depicting a process by which control signals for driving an AMOLED display may be generated. In step 301, image (frame) data are inputted. According to an exemplary embodiment, the input of image data may be arranged in a pixel pipe so that for every clock one, at least one, or a particular number of pixel gray values are received.

In step 302 (Swap 1) a pixel gray value may be swapped to one of the image decomposition LUTs. Swapping may be organized for pixel to pixel. For example, according to an exemplary embodiment, pixel 1 may be sent to block 303 (Decomposition LUT 1), and pixel 2 may be sent to block 304 (Decomposition LUT 2). Swapping may also be organized from frame to frame. For example, according to an exemplary embodiment, block 303 (Decomposition LUT 1) may be applied for every odd frame and block 304 (Decomposition LUT 2) may be applied for every even frame. Alternatively, the process may be realized without Swapping (just one Decomposition LUT), or may involve swapping to more blocks like 4, 6, 8 and so on. For example, according to an exemplary embodiment, 4 LUTs may be used for 4 pixels which are arranged as a square. Pixel swapping and frame swapping may also be combined. According to an exemplary embodiment, the swapping function 302 (Swap 1) between several LUTs may suppress false contours caused by human perception like eye movements.

The result of the image decomposition, both block 303 as well as block 304, may be binary values for an inputted pixel gray value. The result may be stored in a frame buffer.

According to an exemplary embodiment, for digital driving, two buffers (block 306 and block 307) may be used. One buffer (e.g. block 306) may be configured to hold the decomposed binary values of every pixel of the last frame. The other buffer (e.g. block 307) may be configured to store the binary values for a pixel or few pixels of the current frame which is being inputted and decomposed.

Step 305 (Swap 2) may control which of block 306 or 307 is to be written by the results of image decomposition. According to an exemplary embodiment, in the next frame, the roles of both buffers (306, 307) may be exchanged.

Step 308 (Swap 3) may control which of block 306 or 307 is to be read. According to an exemplary embodiment, Swap 3 may function essentially as the opposite of Swap 2 (writing). The buffer holding the decomposed binary values of the last frame (e.g. 306) will be read by the column driver (Block 310) of the AMOLED display. According to an exemplary embodiment, the subframes may be addressed and driven one by one. The binary values may be used to turn on or off the driver transistor (T1 of FIG. 1).

While the binary values of a subframe are being read, in step 311, the number of activated pixels leading to the accordant $n_{ACT}(s)$ value may be counted. In Step 312, the on-duration of the main switch for the accordant subframe ($t_S$) may be determined.

Therefore, according to an exemplary embodiment, by subsequently reading every subframe data, addressing the binary values of the subframe and adjusting the on-duration of the main switch ($t_S$), an image may be properly displayed.

According to an exemplary embodiment, the on-duration of a subframe may not be constant, but may depend on the number of activated pixels. According to such an embodiment, the duration $t_S$ may be adjusted. The adjustment has to consider other properties like that of supply line resistances of the power unit and supply line resistances of the AMOLED panel. These properties are independent of subframe content, but may depend on temperature. The resistances or capacitances vary gradually with the temperature so that the adjustment may be interpolated between few LUTs for few temperatures, provided that the real temperature of the display is sensed or determined. These LUTs may be predetermined at few sample temperatures.

In contrast to resistances and capacitances, the current-voltage characteristic of an OLED is very sensitive to temperature. At a constant supply voltage, 1 Kelvin difference may cause 5% difference of OLED current. Interpolation between few temperature sample points may deliver a significant deviation, so that the adaption of the on-duration $t_S$ may get too much deviation and visible artifacts may arise.

According to an exemplary embodiment, a different approach may be taken to compensate for temperature dependence of OLEDs. The effective output of an OLED may be the light produced by the OLED, which is approximately proportional to the OLED current (which is temperature-dependent as discussed previously). Therefore, an objective of a compensation method for temperature dependence of OLEDs may be to ensure that the OLED current of the activated pixels is at the proper value despite changes in temperature. The current efficiency of OLED has only a small amount of temperature dependence and may be interpolated between few temperature sample points. So, therefore, if the pixel current is met, the brightness of the display may be met, too. The pixel current is essential for the adjustment of the on-duration of a subframe, as Equation 10 shows.

According to one exemplary embodiment, in order to ensure that the OLED current or the display brightness is met, the current may be measured from the power supply. The power supply voltage may accordingly be adapted, within a range of voltage values. The voltage should not be too high, so that the light emission phase is exploited. Likewise, the voltage should not be too low, so that the display brightness can be met.

Turning now to exemplary FIG. 4, FIG. 4 displays an exemplary embodiment of a feedback control loop that may be used to adapt power supply voltage. According to an exemplary embodiment, the current flowing into the AMOLED panel can be measured by an appropriate method, for example by using a shunt resistance or sense transistor parallel to the main switch S1. In FIG. 4 the current measurement device may be represented by the Current Sensor block. The Image Decomposer block may be, for example, a processor and a memory configured to perform the steps of the method shown in FIG. 3, and may deliver the column driver signals applied to the DATA of every pixel circuit and the on-duration for the main switch S1. Since the number of activated pixels of a subframe ($n_{ACT}(s)$) may be provided by Image Decomposer, the pixel current $I_{OLED}$ can be determined according to:

$$I_{OLED} = \frac{I_{SUPPLY}}{n_{ACT}(s)} \tag{14}$$

According to an exemplary embodiment, the pixel current $I_{OLED}$ may be correlated to the brightness of the display (e.g. 300 nits) set by the user or the upper system. If it is too high, the supply voltage $V_{SUPPLY}$ may be reduced by a supply controller, represented by the Supply Control block. If the pixel current is too low, the supply voltage may be increased, again with a supply controller. This way, the brightness of the display may be maintained at an appropriate level. The power consumption of the display may also be kept lower, as only enough power as is needed to achieve the desired pixel currents may be supplied.

In addition, the temperature of the display may be sensed by a temperature sensor, represented as the block Temperature Sensor. According to an exemplary embodiment, a temperature sensor may be configured to measure, for example, the average temperature of the display or several different localized temperatures of the display, but may not be configured to measure the temperature of every pixel. The average pixel current, as measured according to Equation 14, may also be correlated to a temperature. The temperature value may be used to adapt the $R_{SUPPLY}$ value of Equation 2 and/or the current efficiency $\eta$ in Equation 11. The adjustment of the on-duration $t_S$ according to Equation 11 and/or Equation 12 or its LUTs may be accurate. The influence of the temperature on the display may thus be properly considered.

Equation 14 may allow the determination of a local temperature distribution on the panel, since the activated pixels are usually not uniformly distributed over the panel. Once a temperature of the activated pixels of a subframe is estimated or measured, this temperature may be assigned a geometric position corresponding to the centroid of the activated pixels of the subframe. Thus, a non-uniform temperature distribution at lower spatial resolution may be estimated.

According to an exemplary embodiment, because the temperature of the display does not change extremely rapidly, the current measurement may not be executed frequently; for example, it may not be executed frame by frame or even subframe by subframe. The subframes with long on-duration ($t_S$) and more activated pixels may be preferred, as the current measurement for such a subframe may be easier and/or more accurate.

Certain downsides to this approach may still exist. For example, while the temperature over the whole display may be non-uniform, the temperature profile will not replicate this exactly, though it may achieve low spatial frequency. The hardware of the AMOLED display may also be non-uniform; for example, the OLED pixels may have a non-uniform current distribution with a low spatial frequency profile due to the production process. However, these downsides do not present major problems, as these low frequency profiles will be perceived as uniform. This approach may still allow the uniformity of such an AMOLED display to be significantly better than that of most LCDs.

However, another severe non-uniformity problem may still arise. Each AMOLED pixel will receive different stresses during the lifetime of the display, as an image is due to its nature non-uniform. Over the time accumulated, every pixel may have different aging history and status. For example, if a user watches a particular TV station often, the logo of the TV station may be displayed for a very long time at essentially the same location, stressing similar groups of pixels. These pixels may deteriorate more than other pixels. If an image without this logo is displayed, this logo may still be perceivable as a dark shadow. Such an artifact is called as image sticking or image retention and is common with active emitting displays like CRT and PDP, but also AMOLED. According to an exemplary embodiment, image sticking and other non-uniformities may also be compensated for, for example by the use of current measurement.

A brief summary of the main phenomena of OLED aging may first be described. It may be divided into two drift phenomena. One is the drift of the current-voltage (I-V) characteristics of the OLED over time. The second one is the drift/decrease of the current efficiency (cd/A) over operation time.

Turning now to exemplary FIG. 5, FIG. 5 shows the I-V curves of an OLED at two different stages. After many hours of operation time, the I-V curve of the OLED may shift from the initial I-V curve (marked "Initial" in the graph of FIG. 5). If a constant current is injected (dotted line), the OLED voltage usually increases over time; for example, in the graph of FIG. 5, the OLED voltage shifts from approximately 3.6 V to 3.95 V at a constant current. This is the analog driving mode, as state of the art for AMOLED displays. Such a behavior is less critical in respect of I-V drift, as the increased OLED voltage will be absorbed by the driver transistor of the AMOLED pixel circuit (e.g. T1 in FIG. 1), which is operated as a current source. The luminance is not decreased/altered, provided that the pixel circuit works properly and is stable.

Alternatively, however, a constant voltage can be applied; this is the digital driving mode. If a constant voltage is applied (dashed line), the OLED current decreases with operation time. This may have severe consequences for the display, as the luminance is proportional to OLED current, and maintaining a constant voltage will cause the luminance to decrease with operation time due to the I-V drift. Therefore, digital driving is more susceptible to image sticking or may have a shorter lifetime than analog driving, if no specific compensation method is applied.

However, according to an exemplary embodiment, the idea of current measurement can be applied again. For example, the current of a display, but also of a pixel or a plurality of pixels, can be measured electronically. This means that it can be measured, under most operating conditions of the electronic device containing an AMOLED display. According to an exemplary embodiment, for compensating image sticking, every pixel current may be measured.

According to an exemplary embodiment, the pixel circuit may be modified so that the pixel current can be measured during active operation. Also, other values like OLED capacitance may indirectly be measured. Such a measurement method during active operation may require more connections for each pixel, which may make the connection of the display panel more complex. This may lower the aperture ratio of some or all of the pixels. Furthermore, such a configuration may require high speed measurement units in the external circuitry.

According to an exemplary embodiment, since OLED aging is a slow process, such a measurement like current, capacitance or other values may be executed by an electronic unit periodically, e.g. once every 10 hours of active operation. In an embodiment, the pixel current may be measured by measuring the current from the power supply. According to an exemplary embodiment, current measurement may be executed when the display is passive. According to such an embodiment, the period between two measurements may be variable, as the AMOLED display may be in a passive state at different times. In an embodiment, the period between measurements may be extended after a long operation time, as this may slow the speed of the drift.

For the pixel current measurement, a standard measurement device, such as a current sensor (for example, a similar one to that represented by the Current Sensor block in FIG. 4) may be used. According to an exemplary embodiment, current sensor may be capable of measuring a relatively low current (e.g. in 1 micro Ampere range) in a reasonable resolution like 10 bits.

According to an exemplary embodiment, for the pixel current measurement, just one pixel of the display may be activated at a time. The current of this pixel is the total display current measured. Possible leakage current can be eliminated by well-known methods like correlated double sampling. Thus, a measurement unit which is not a part of the display may allow the measurement of just one pixel. The AMOLED display panel needs not to be modified.

For this measurement, the supply voltage $V_{SUPPLY}$ may be set to a different value as for the active operation. This may allow an increased signal to noise ratio of the measurement or a better aging model with higher correlation, as will be described later. By subsequently measuring the pixel currents over the entire display, the pixel current distribution can be obtained.

According to an exemplary embodiment, the OLED voltage may be measured while a constant current is injected into the display. However, this method is much less sensitive than the current measurement at a constant voltage. In addition, pixel current measurement at a constant voltage fits well to digital driving, as in real operation a constant voltage is applied, too.

Thus, in an exemplary embodiment, just one current measurement unit may suffice for the whole display. One unit may allow a current measurement for executing Equation 14 and the pixel current measurement. For a reasonable accuracy and resolution, two measurement ranges may be realized in the current measurement unit, one for higher current for Equation 14 and one for lower pixel current. As the display panel is in passive state, the speed of pixel current measurement is not critical. The temperature distribution over the panel may be uniform and equal to the ambient temperature at the time of measurement; according to an exemplary embodiment, the ambient temperature may be measured at the time of measurement, so that possible temperature dependence can be properly considered.

The result of such a measurement may be represented as a pixel current distribution; in some embodiments, this may have a high spatial frequency, because some pixels are much more stressed than others. The pixel current distribution is denoted in this description by $IP_{M\times N}$.

The $IP_{M\times N}$ matrix may be filtered by a low pass filter, e.g. by averaging a cell of 21×21 pixels. According to an exemplary embodiment, the size of the cell may be correlated to a spatial frequency which is not perceivable. The output is a new matrix $LP_{M\times N}$. This filtered pixel current distribution may be considered as the objective for the compensation. There are of course other methods to compile the objective matrix $LP_{M\times N}$ like the initial pixel current distribution or the average value of the whole pixel current distribution, or the initial pixel current distribution scaled by the ratio between the current average current and the initial average current.

According to an exemplary embodiment, a ratio between each element of the pixel current distribution $IP_{M\times N}$ and $LP_{M\times N}$ may be determined, and may be stored as an element of a new matrix $C_IV_{M\times N}$, which may be used for compensation against I-V drift. This value may be calculated as:

$$C_IV_{ij} = \frac{LP_{ij}}{IP_{ij}} - 1 \tag{15}$$

In Equation 15, $C_IV_{ij}$ may be a factor for compensation against OLED I-V drift. The factor $1+C_IV_{ij}$ stands for the ratio between a reasonable (target) pixel current (LPij) for suppressing perceivable non-uniformity like image sticking and the real aged OLED pixel (ij) current. For most pixels the ratio may have the unit value, meaning that $C_IV_{ij}$ is zero. For the pixels which abruptly differ from the adjacent pixels, for example because the pixel has been displaying a bright logo/symbol for a long time, this ratio may be higher than one, e.g. 1.2 (so $C_IV_{ij}$ is 0.2). The $C_IV_{ij}$ values may be stored in a non-volatile memory (NVM). The values of every pixel of the display can of course be stored. Since just a small part of the pixels may substantially be aged or substantially more strongly aged than other pixels of the display, the memory may just store the values of the aged pixels. The identities of the pixels like the position may be stored, too. This may lead to a smaller memory than the memory for the complete display.

If the electronic device containing an AMOLED display is powered on, the $C_IV_{ij}$ values stored in NVM may be read into a SRAM memory for real time processing. When a new pixel current measurement is performed, new values for $C_IV_{ij}$ may be determined and stored in NVM again.

It may happen that during the long operation time of the AMOLED display, many pixels are similarly aged; this may even happen to every pixel. Such a case is usually not a real problem like image sticking. The brightness of the display may get lower what is hardly perceivable and will not be perceived as annoying. Such a behavior is for example common in LCDs and widely accepted. Therefore, no compensation may be required. The compensation factor for every pixel ($C_IV_{ij}$) may be equal or substantially equal. If the average pixel current is set as the objective, it may lead to $C_IV_{ij}$ values of zero. In this case, the brightness of the display may be lower than that at the initial state.

However, according to an exemplary embodiment, the display brightness can of course be held at a specified level despite an advanced aging state of the display, if the initial state or a specified brightness is set as the objective. However, high display brightness may reduce its lifetime. How to set the objective may depend on the application.

The real issue of OLED aging is, as mentioned before, abrupt change from one pixel to the next pixel or high frequency part in the pixel current distribution. A change of 5% or even less may be perceived. Such non-uniformity needs to be compensated for. One straightforward method for compensating for the non-uniformity due to the OLED I-V drift is to manipulate the gray value for this pixel. For example, an equation including the compensation factor that may be used to manipulate this value may be:

$$GV_COMP_{ij} = GV_{ij} + C_IV_{ij} \cdot GV_{ij} \tag{16}$$

Since any pixel including aged ones may receive a full-scale gray value, certain surplus may be reserved for the compensation. This means that the supply voltage according to Equation 2 may be set slightly higher, so that OLED current $I_{OLED}$ can reach the level $(1+C_IV(max))*I_{OLED_O}$. C_IV(max) may be the maximum value of the $C_IV_{M\times N}$ matrix, and $I_{OLED_O}$ may be the OLED current of an unaged pixel or the average OLED pixel current, depending on the objective matrix $LP_{M\times N}$. For example, if the full-scale gray value is 1023, this may mean that the increased supply voltage allows the generation of 1228 for C_IV(max)=0.2. Such a requirement may be consistent with Equation 8 and cover by the sum of all luminance factors $\Sigma L_S$. If not, it may be realized by higher supply voltage ($V_{SUPPLY}$ in FIG. 1).

As simple as Equation 16 may look like, for an accurate compensation to be performed, which may be required in order to improve the appearance of the display to sensitive human perception, other effects like the dependence of the operation point may need to be considered. Since every subframe may have an own operation point, an own compensation factor for every subframe may be needed. This again may need a specific algorithm for the compensation of the non-uniformity induced by different aging status of OLED pixels. Before describing such an algorithm, another critical aging/drift effect may first be described and considered.

Aging and drift of the OLED may not be limited to its I-V characteristics. In an embodiment, the I-V characteristic of an OLED may drift with operation time, and the current efficiency of the OLED may also drift with operation time. This means that the ratio between the light emitted by the OLED and the OLED current may not be constant over time. The current efficiency may be described by the unit (cd/A) and usually decreases with the operation time. Thus, even if the OLED current is constant, e.g. if the OLED is analog driven, the luminance of two adjacent OLED pixels may be different due to different current efficiencies. Thus, image sticking may appear. For digital driving, the I-V drift may be compensated e.g. by the method described above, which means that the average OLED current may be constant. However, due to the drifted/decreased current efficiency image sticking may appear, too.

Compensation against the drift of the current efficiency can be used to suppress artifacts like image sticking. It may be applied for analog driving as well as for digital driving. One challenge, however, is the determination or estimation of the current efficiency, at least in a relative scale. The luminance can be measured by a photometer, but not measured in an electronic circuit. If the electronic device with an AMOLED display is with the user, a photometric measurement is usually not practical, while electrical measurements of the AMOLED display may be performed/executed.

A possible approach is to measure electrical characteristics of an OLED, when the electronic device is with the user. The electrical measures may be correlated to the current efficiency.

In one embodiment, the pixel current distribution may be measured by an electronic unit, as described above and applied for compensating I-V drift. Other measurements, like the measurement of the OLED capacitance or impedance measurements, may be performed by an electronic unit, too. In another embodiment, any type of electrical measurement having a good correlation between the measured quantity and the current efficiency may be taken. Such a correlation may be called, or may be used to generate, an aging model as it appears in this description. An aging model may combine values of several measurements for different aging states, different operation points and different measurement methods. The objective is that the correlation should be as high as possible (up to 100%), so that the pixel luminance may closely be met and the deviation caused by compensation is low.

According to an exemplary embodiment, the method of data-counting, which has been used in plasma displays, may be applied, combined and included in the aging model. The data-counting method calculates the accumulated stresses an OLED has received. Based on this stress calculation, the drift of current efficiency for the OLED may be estimated. This method of calculation may be "look-ahead" or predictive, while a correlation function based on electrical measurements may be a feedback method. The combination of both methods may deliver a more dependable result, so that the deviation of the calculated current efficiency to the real current efficiency may be limited.

Various correlation functions may be applied for different aging states or operation conditions; for example, different correlation functions may be provided for differences in luminance, temperatures, or any other applicable conditions. For different OLEDs, like RGB diodes, different aging models may be applied. Also, past electrical values may be stored e.g. in a non-volatile memory and used for the choice of the proper function for the correlation, and the determination of the relative current efficiency.

In an exemplary embodiment, a simple correlation function may be a linear relationship between the decrease of the normalized current efficiency and the decrease of the normalized OLED current. For example, an equation similar to that provided in Equation 17 may be used.

$$\frac{\Delta\eta}{\eta_o} = \frac{\eta_o - \eta}{\eta_o} = k \cdot \frac{\Delta I}{I_o} = k \cdot \frac{I_o - I}{I_o} \tag{17}$$

In this function, k may be a constant. According to an exemplary embodiment of an aging model, the compensation factor against the drift of OLED current efficiency (η) may be related to the compensation factor against IV drift C_IV:

$$\text{C_EFF} = \frac{\eta_o}{\eta} - 1 = \frac{\Delta\eta}{\eta} = \frac{k \cdot \text{C_IV}}{1 - (k-1) \cdot \text{C_IV}} \tag{18}$$

Equation 18 provides an example of how the compensation factor against the drift of current efficiency may be determined based on electrical measurements, in this particular case pixel current measurement. Equation 17 may also incorporate other terms, such as initial conditions or multiple constants, and may be extended accordingly:

$$\frac{\Delta\eta}{\eta_o} = k_0 + k_1 \cdot \frac{\Delta I}{I_o} \tag{19}$$

The above equation, Equation 19, may have two parameters and may allow a higher correlation than Equation 17. The compensation factor against the drift of OLED current efficiency (η) may be derived as:

$$\text{C_EFF} = \frac{k_0 \cdot (1 + \text{C_IV}) + k_1 \cdot \text{C_IV}}{1 - k_0 \cdot (1 + \text{C_IV}) - (k_1 - 1) \cdot \text{C_IV}} \tag{20}$$

Turning now to exemplary FIG. 6, FIG. 6 depicts an exemplary plot of the normalized current efficiency change (y-axis) versus normalized current change (x-axis) of an exemplary OLED device at various aging states (up to 1737 hours).

As depicted in FIG. 6, the OLED current measurements are performed at three different OLED voltages (3.2, 3.6 and 4.0 volt), so that three parameter sets ($k_0$, $k_1$) for the correlation function of Equation 19 may be mapped.

As depicted i$_n$ ex$_e$mplary FIG. 6, for the operation point of 3.6 V, the correlation is 93.9%. For 4.0 V the correlation is 85.18%, still at a very high level. For 3.2 V the correlation is 92.64%. The choice of the operation point for the measurement may influence the quality of the aging model.

For an unaged OLED, the model according to Equation 19 may cause an unnecessary fault, since the parameter $k_0$ may have a non-zero value. This fault may be eliminated or limited by setting C_EFF to zero, if the change of the pixel current or C_IV is below a certain threshold value. Equation 19 may thus be rewritten as:

$$\frac{\Delta\eta}{\eta_o} = k_0 + k_1 \cdot \frac{\Delta I}{I_o} = k_1 \cdot \left(\frac{\Delta I}{I_o} + \frac{k_0}{k_1}\right) = k_1 \cdot \left(\frac{\Delta I}{I_o} - d_0\right) \tag{21}$$

In the example of FIG. 6, the parameter $k_0$ has a negative value, which may have a physical reason or may be a weakness of the linear model. If the normalized current change is below the intersection value $d_0$, the normalized current efficiency change may be set to zero. C_EFF is zero. If the normalized current change is above $d_0$, the normalized current efficiency change can be calculated according to Equation 19 or Equation 21. C_EFF can be calculated according to Equation 20.

Also, a higher order function for the aging model may be applied, which may improve the accuracy of the function at an initial value and/or other states. For example, a second-order (or higher-order) polynomial, or an exponential or logarithmic function, may be used instead of a linear model, if desired.

According to an exemplary embodiment, the aging speed of an OLED may be much faster when the OLED is new, as compared to when the OLED has been in use for a long time. Since the aging speed of an OLED may at the pristine state be much faster than in a state after a long operation time, a pre-aging process may mitigate this problem. The AMOLED panel may uniformly be stressed at the maximum luminance and at a high temperature for few hours so that the period of highest drift rate of the OLEDs is left behind. Such a process may postpone image sticking and make the aging model less susceptible to same. Also, the intersection value do for the Equation 21 may be reduced.

In an exemplary embodiment, the data counting method may be applied, particularly for slightly aged pixels. The application of this method may be described in more detail below.

The model equations above exemplarily show how the drift of the current efficiency can be correlated to the I-V drift. As mentioned before, the decrease or drift of OLED current efficiency may be correlated to other electrical values measured during the lifetime of an AMOLED display. Several electrical values from different operation points, different measurement methods and different states may be used to determine the normalized change of current efficiency. These values may be processed by spatial filter for suppression of noise and/or interference of the measurement. The output may be the normalized change of the current efficiency, $\Delta\eta/\eta_o$.

In the above relation, according to an exemplary embodiment, $\eta_o$ may be used to represent some objective state of the current efficiency, and may, for example, be the initial value, a filtered value of the current state and so on. The compensation factor against the drift of the efficiency may be formed as:

$$\text{C_EFF} = \frac{\eta_o}{\eta} - 1 = \frac{\eta_o}{\eta_o - \Delta\eta} - 1 = \frac{\Delta\eta/\eta_o}{1 - \Delta\eta/\eta_o} \tag{22}$$

In addition or as alternative to pre-aging, the data counting method may be integrated into the aging model. The stress on an OLED pixel may be accumulated. This may be represented in equation 23:

$$S_\text{ACCU}_{ij} = \Sigma_{t=t1}^{t=t2} w(t) \cdot G_{ij}(t) \tag{23}$$

In equation 23, t1 is the starting time of accumulation and t2 the end of accumulation. According to an exemplary embodiment, t1 may be zero for the very beginning of operation and t2 the current time. w(t) may be a weighting factor and may be a function of temperature, the brightness of the panel etc.

This equation may be amended to consider the drift of current efficiency, which may be represented in equation 24:

$$S_\text{ACCU}_{ij} = \Sigma_{t=t1}^{t=t2} w(t) \cdot [G_{ij}(t) + C_\text{EFF}_{ij} \cdot G_{ij}(t)] \tag{24}$$

The drift of current efficiency may be estimated as a function of the stress accumulated ($\text{S_ACCU}_{ij}$). This may be represented in equation 25:

$$\text{C_EFF_A}_{ij} = \frac{\eta_o}{\eta} - 1 = ACCU(\text{S_ACCU}_{ij}) \tag{25}$$

According to some exemplary embodiments, the function ACCU(S_ACCU) may be obtained or approximated based on simulation, measurement, and/or estimation for OLED devices at various stages of stress/aging tests in the laboratory. The first phase of the tests may be of particular interest, as the drift speed may be high. In an embodiment, since the operation point at digital driving is roughly constant, the data counting model may deliver a more accurate result.

In some embodiments, the data counting method may be more dependable for a short period than for a long period, as possible deviation may be accumulated over a long period of stresses. Thus, it may be reasonable to combine the data counting method and the method based on electrical measurement, which may yield a combination that is relatively accurate over short and long periods. The factor C_EFF in Equation 22, which is based on electrical measurement, may now be denoted as C_EFF_E. The values for C_EFF_E and C_EFF_A (with C_EFF_A, as above, being based on the data counting method) may be merged yielding to a combined value C_EFF:

$$C_\text{EFF} = \text{prio}(S_\text{ACCU}) \cdot C_\text{EFF_}A + [1 - \text{prio}(S_\text{ACCU})] \cdot C_\text{EFF_}E \tag{26}$$

According to an exemplary embodiment, the function prio(S_ACCU) may deliver a value between 0 and 1. This may, for example, represent the desired relative weighting of C_EFF_E and C_EFF_A, based on the age of the pixel. For the initial state or an early stage, the value may be one. For the case that a pixel has been stressed for a long time (S_ACCU is high), the prio( ) function may deliver a value of zero. The transition for prio( ) from one to zero may be a non-linear function of S_ACCU.

According to an exemplary embodiment, while the C_EFF_E values are based on a past state, namely at the time of the last electrical measurement in a passive state, the C_EFF_A may be of the current state of the OLED, as S_ACCU may be gained during active operation of the display panel. The C_EFF value according to Equation 26 may thus be generated during real-time operation. This may make sense particularly if the pixel is just slightly stressed in the operation of the display, as the drift speed of an OLED in such an aged state may be higher than in a strongly aged state.

According to an exemplary embodiment, if the AMOLED display is operated for a very long time without interruption, the C_EFF_E values may be very old and of potentially diminished accuracy. In this case, the prio( ) function may have a higher value, so that the real-time value C_EFF_A may get more weight, reducing the impact that the old C_EFF_E values have on the resulting calculation.

According to an exemplary embodiment, the data counting model may also be applied to examine the consistency of the aging model and/or its electrical measurement at a strongly aged state. For example, in one such application of the model, the starting point of the accumulated stress at the last aging state may be represented as SA1, when electrical values are measured. The compensation factor against the drift of current efficiency may be C_EFF1.

The current accumulated stress may be represented as SA2, and the electrical values may be measured again at the current point. According to the aging model, the compensation factor against the drift of current efficiency is C_EFF_E2. The following equation should roughly be met:

$$C_\text{EFF_}E2 = \text{ACCU(SA2)} - \text{ACCU(SA1)} + C_\text{EFF1} \tag{27}$$

The deviation for the RHS of the equation above may be limited, as SA1 and SA2 are usually close to each other. In case the C_EFF_E2 delivers a significantly different value, a new electrical measurement may be started. In another embodiment of this equation, the two values of the LHS and RHS of the equation may be combined, so that a sum or deviation may be obtained. This way, the deviation of C_EFF2 values may be tracked, and may be limited if determined to be excessive.

Overall, the data-counting model may allow for compensation against the drift of current efficiency in real-time. The application of such a real-time or look-ahead value is advantageous, particularly for slightly aged pixels. It is also useful, if the display is operated for a long period without any interruption, so that no electrical measurement in a passive state of the display can be performed. With each electrical measurement at a certain time point, the compensation factor may be calibrated according to Equation 26. It may secure the electrical measurements and make the aging model more dependable.

The compensation factor against the I-V drift and the compensation factor against the drift of current efficiency may be combined, yielding one single compensation factor. This may be represented in equation 28 below:

$$CF_Total=(1+C_IV)\cdot(1+C_EFF)-1 \quad (28)$$

This equation may also be presented in a simplified form:

$$CF_Total=C_IV+C_EFF \quad (29)$$

The above equation can be used to compensate for the two major drift phenomena and allow for the suppression of image sticking artifacts, which may thus enhance the lifetime of an OLED display.

According to an exemplary embodiment, as mentioned previously, the electrical measurements may be performed when the display is in a passive state. The electrical measurements that are taken may be processed according to the aging model that is chosen. According to an exemplary embodiment, the compensation factor $CF_Total_{ij}$, for every pixel or for aged pixels, may be the output, which may be stored in a non-volatile memory. According to an exemplary embodiment wherein the aging model incorporates electrical values of past states, the electrical measures of the current state may be stored in NVM for the calculation of the compensation factor after the next measurement. In this description, the compensation factors, stress accumulated and/or electrical values stored in NVM may be referred to generally as aging state parameters.

With the factor CF_Total Equation 16 for the manipulated gray value may be amended to:

$$GV_COMP_{ij}=GV_{ij}+CF_Total_{ij}\cdot GV_{ij} \quad (30)$$

This manipulated gray value $GV_COMP_{ij}$ may be used as the input value for the image decomposition as in the flow shown in FIG. 3 and described before.

In order to improve the accuracy of compensation, the variation of the OLED voltage due to the different number of activated pixels for each subframe may be considered. Variations in OLED voltages between subframes may be significant, particularly if the difference of the OLED voltages between two subframes may be high e.g. due to high resistance $R_{SUPPLY}$ and/or high $I_{OLED}$ (correlated to the brightness of the display set). In these cases, reliance on one compensation factor $CF_Total_{ij}$ for every subframe as applied in Equation 30 may cause perceivable deviation. It may therefore be reasonable to amend the compensation factor by considering its dependence on the operation point of OLED.

FIG. 7 is a plot depicting the behavior of an exemplary OLED at a variety of aging states, which illustrates an example of the influence of the operation point. The ratio between the current of an OLED device at various aging states (from 46 h, the top line, to 1717 h, the bottom line) and the current at the pristine state in dependence of the OLED voltage is shown. For example, the ratio between the current of the OLED device at a first aging state (46 h) and the current of the OLED device at a pristine state (0 h) may be approximately 0.9 at lower voltages (approximately 3.0 V) and approximately 0.8 at higher voltages (approximately 4.0 V). For digital driving, the operation range is narrow and at relatively high voltage, e.g. 3.8-4.0 V. The ratio in this narrow range may still exhibit some variation.

This means that the compensation factor $C_IV_{ij}$ may depend on the real operation point $V_{OLED}$ or the number of activated AMOLED pixels $n_{ACT}(s)$. This dependence may be different at different aging states. The compensation factor against the I-V drift may be a function of $n_{ACT}(s)$ and therefore individual for each subframe. It is denoted as $C_IV(s)_{ij}$, and may have the following value:

$$C_IV(s)_{ij}=C_IV_{ij}\cdot[1+RATIO(n_{ACT}(s),STATE_{ij})] \quad (31)$$

In the above equation, C_IV(s)ij stands for the compensation factor against I-V drift for the s-th subframe and $n_{ACT}(s)$ is the number of active pixels for the s-th subframe. According to an exemplary embodiment, $C_IV_{ij}$ may be a value based on measurement in a previous passive state of the display and stored in a memory. It may be valid for a defined operation point. "$STATE_{ij}$" stands for the aging state of the OLED pixel which may be described by aging state parameters like $C_IV_{ij}$. The function RATIO( ) may consider the influence of the operation point and the aging state. In some embodiments, it may be based on simulation, measurement, or estimation, or another generation method, for OLED devices at various stages of stress/aging tests in the laboratory. If $C_IV_{ij}$ is zero, this may indicate that no compensation for the pixel is required. Otherwise, the compensation factor may incorporate the influence of $n_{ACT}(s)$, and thus may be used to adapt the operation point of the OLED.

According to an exemplary embodiment, a compensation factor against the drift of the current efficiency may incorporate information about the operation point. Turning now to exemplary FIG. 8, FIG. 8 shows a plot of the normalized current efficiency of an OLED device at various aging states (from 46 h till 1717 h) for OLED voltages of 3.0 to 4.0 volts. In some embodiments, the change of efficiency for the same aging state may not be constant over the operation point. The operation range of digital driving is compared to analog driving in a narrow range (e.g. 3.8-4.0V). Nevertheless, some variation of the current efficiency may exist, with this variation becoming more significant when the OLED is in a strongly aged state. Therefore, the consideration of the dependence of the normalized current efficiency on the operation point may assure a higher accuracy of the compensation and thus suppress image sticking for a longer lifetime of the display.

In order to incorporate information about the operation point, the compensation factor against the drift of the current efficiency may be determined by a function like Equation 32:

$$C_EFF(s)_{ij}=C_EFF_{ij}\cdot[1+EFF(n_{ACT}(s),STATE_{ij})] \quad (32)$$

$n_{ACT}(s)$ stands for the operation point $V_{OLED}$ which may be an individual value for every subframe. "STATEij" stands for the aging state of the OLED pixel which may be described by aging state parameters like C_EFFij. The values $C_EFF_{ij}$ and $STATE_{ij}$ may be stored in a memory and updated, when the display is measured in a passive state. The function EFF( ) can be based on, for example, simulation, measurement, or estimation for OLED devices at various stages of stress/aging tests in the laboratory.

Equation 28 may likewise be amended to:

$$CF_Total(s)_{ij}=(1+C_IV(s)_{ij})\cdot(1+C_EFF(s)_{ij})-1 \quad (33)$$

A compensation factor for every subframe may thus be calculated, provided that the operation point for every subframe ($n_{ACT}(s)$) is known. The operation point may be obtained as a result of the image decomposition. The relationship by which the operation point may depend on, for example, the image decomposition of manipulated gray values and the correction factor may be an interdependent problem needing a specific algorithm for an aged AMOLED display.

If no compensation is required, an image may be decomposed according to Equation 9 to:

$$I_{m\times n}=\Sigma_{s=0}^{q-1}B(s)_{m\times n}\cdot L_S$$

And, as described in Equation 5, the gray value of a pixel $GV_{ij}$ may be:

$$GV_{ij}=\Sigma_{s=0}^{q-1}B(s)_{ij}\cdot L_S$$

By applying a compensation factor for each subframe, as described in Equation 34, the gray value may be changed to a new value, $GV_COMP_{ij}$:

$$GV_COMP_{ij}=GV_{ij}+\Sigma_{s=0}^{q-1}B(s)_{ij}\cdot L_S\cdot CF_Total(s)_{ij} \quad (34)$$

The index s stands for the s-th subframe. According to an exemplary embodiment, each subframe may have a corresponding compensation factor $CF_Total(s)_{ij}$. The new manipulated gray value GV_COMP may be decomposed according to Equation 5. However, as mentioned, there may be several interdependent variables involved in this problem, and decomposition of GV_COMP may not be straightforward. The binary values are gained from the decomposition of GV_COMP. On the other hand, the binary values of all pixels of a subframe make together $n_{ACT}(s)$. The $n_{ACT}(s)$ number influences the CF_Total(s) value and thus also GV_COMP. For solving such an interdependent problem, a complex iterative method may be used.

Turning now to exemplary FIG. 9, FIG. 9 discloses an exemplary embodiment of a method by which an image may be decomposed 900. According to an exemplary embodiment, a Pixel Gray Value Gij may be provided, represented by the block Input Frame 902; according to some embodiments, this may be a pixel pipe. In a first step the original pixel gray value Gij may be decomposed by one or one of several Decomposition LUTs 904 yielding to the binary values $B(s)_{ij}$ for this pixel, as described in the FIG. 3.

For the sake of simplicity, the three swap functions, several decomposition LUTs and the two buffers for writing and reading the decomposed binary values, as shown in FIG. 3, are not drawn in FIG. 9. However, they may be included, for example in a configuration similar to that of FIG. 3.

For the calculation of the manipulated gray value (GV_COMPij) 906, Equation 34 may be applied, provided that the compensation factors 908 that take into account the dependence of the operation point are available.

According to some exemplary embodiments, images/videos to be displayed may be displayed at a frame rate of 60 Hz or higher frequency. This means that, in typical instances, the change from one frame (image) to the next frame (image) in most cases may be limited. Therefore the values and/or information from the last frame may be used for the determination of the control signals for the current frame which are primary the binary subframe matrices as the result of image decomposition. This approach may decouple the interdependence between decomposition of the manipulated gray value and the operation points. While in certain instances, for example when there is a scene cut between frames with a strong change in the scenes, the values and/or information of the last frame may not be usable to generate optimal control signals, such transitions may be limited to one frame, which may be hardly perceivable, particularly immediately after a scene-cut.

According to an exemplary embodiment, in the case that few decomposition LUTs are used for a pixel and swapped from a frame to another, the operation points of the subframes from the accordant one of the last frames may be used, like the second last frame, if two LUTs are temporally swapped.

In an embodiment, the block Compensation Factors Subframes 908 may calculate the compensation factors of a pixel for all subframes by using equations like Equation 31, Equation 32 and Equation 33. The inputs may be the operation points from the last frame which may be stored as $V_{OLED}$ or $n_{ACT}(s)$ for all subframes and the aging state parameters of the pixel like C_IVij and C_EFFij. The output of this block may be the q compensation factors for the pixel CF_Total(s)ij.

After the initial decomposition of the original pixel gray value with the results for $B(s)_{ij}$, a new manipulated gray value of this pixel (GV_COMPij) may be calculated by the block Calculation-Manipulated-Gray-Value 906 according to Equation 34. This manipulated gray value may be decomposed again 904. The decomposition may lead to new binary values B(s)ij. In further iterations 910, these new binary values may be inputted to the block Calculation-Manipulated-Gray-Value 906 leading to a new manipulated gray value according to Equation 34, which may be decomposed again 904. After few (e.g. 6) iterations the manipulated gray value may just slightly change from one iteration to the next iteration, or may be stable or substantially stable. The binary values of the last iteration may be the control signals for digital driving which are first stored in the block Buffer 912.

In an embodiment, since the decomposition of a gray value may be a simple procedure e.g. based on LUTs, the procedure with few iterations may just need simple logics and can be processed within a limited and defined number of clocks. The pixel data of an image may be inputted and processed in a pipeline. The output is the binary values of the pixel which are stored in the Buffer 912.

According to an exemplary embodiment, when every pixel of a frame has been inputted and processed this way, the Buffer 912 may hold the complete binary matrices for the subframes. The binary values may be used to address the active matrix pixels (Column Driver) 916. The total number of activated pixels of a subframe ($n_{ACT}(s)$) is known so that the on-duration of the main switch 914 for each subframe may be adjusted. The operations points 918 for the subframes may be determined and stored in a memory, so that they can be used for the next frame for calculation of the compensation factors for each subframe. Thus this image decomposition process 900 may be repeated for the next frame and so on.

In the description above, it is assumed that the voltage drop across the column and/or row line is negligible, so that every activated pixel receives the same voltage. In case that the display brightness is very high or the OLED device is not highly efficient or the column/row line resistance is not very low, the voltage drop across the column/row line may cause substantially different pixel current. The pixel current distribution is in this case not uniform, so that the assumption of one voltage for all pixels may cause static false contours or other artifacts.

The non-uniform voltage/current distribution may be simulated according to a method disclosed in U.S. Pat. No. 8,743,160, herein incorporated by reference. In U.S. Pat. No. 8,743,160, the aging effects are not considered. In this description, the algorithm according to FIG. 9 of U.S. Pat. No. 8,743,160 is amended by aging compensation.

Turning now to exemplary FIG. 10, FIG. 10 may show a flowchart of a method for generating a sequence of binary-value subframes used for driving an AMOLED display from a gray-value image (input frame).

In step 1001, the original gray value of a pixel (ij) may be inputted.

In step 1002, a matrix B(0) may be designated, wherein B(0) corresponds to the brightest subframe having the highest luminance factor $L_0$. According to an exemplary embodiment, the determination of which subframe is the brightest may be accomplished by, for example, a simple compare function. The threshold value for the compare function may be $L_0*(1+CF_Total(0)_{ij})$. The value of $CF_Total(0)_{ij}$ from the last frame may be used. If the pixel gray value $G_{ij}$ is greater, then $B(0)_{ij}=1$. Otherwise, $B(0)_{ij}=0$. The determination of $B(0)_{ij}$ may follow the image data pixel-wise. That way, the first subframe matrix B(0) may be obtained.

In step 1012, in an embodiment, the B(0) information may be immediately used to address the display pixels. After addressing, the main switch may be turned on for a duration correlated to $L_0$, so that the AMOLED display may produce the first subimage SI(0). The on-duration for a subframe may consider the influence of the internal capacitance of the OLED and may be realized by high temporal accuracy and resolution.

In step 1003, a simulation method, such as the simulation method described in U.S. Pat. No. 8,743,160, may be applied. For considering the I-V drift of OLED, the current of a pixel may be described by equation 35:

$$I_{ij}=I_{OLED}[\text{Voled}_{ij}]/[1+C_\text{IV}(\text{Voled}_{ij})] \tag{35}$$

In equation 35, $I_{OLED}[\text{Voled}_{ij}]$ may be the current-voltage characteristic of OLED in the initial state and may be a LUT function. According to an embodiment, this function may be or may resemble an exponential function. $C_\text{IV}(\text{Voled}_{ij})$ may denote the compensation factor against the I-V drift at the operation point $\text{Voled}_{ij}$. It may be calculated according to a process similar to equation 31, described in Equation 36:

$$\begin{aligned} C_\text{IV}(\text{Voled}_{ij})&=C_\text{IV}_{ij}\cdot[1+\text{RATIO}(n_{ACT}(s),\text{STATE}_{ij})]=\\ &C_\text{IV}_{ij}\cdot[1+\text{RATIO2}(V_{OLEDij},\text{STATE}_{ij})] \end{aligned} \tag{36}$$

$n_{ACT}(s)$ may be substituted by $\text{Voled}_{ij}$ according to Equation 2. The function RATIO( ) is transferred to the LUT function RATIO2( ). According to an exemplary embodiment, the simulation method can have steps for estimating a value for a voltage/current for a selected node of the column; calculating at least one of a voltage value and a current value for remaining nodes of the column, based on one of an estimated voltage or current value; and iterating these steps in order to reduce a difference between a calculated voltage or current value and a real voltage or current value at a chosen location of the column.

In an embodiment, the pixel current distribution for the binary subframe matrix B(0) may be simulated. The operation point for every pixel for this subframe may be known. The luminance of a pixel may be calculated according to Equation 37:

$$SI(0)_{ij} \sim \frac{I_{ij}\cdot t_0}{1+\text{C_EFF}(Voled_{ij})} \tag{37}$$

$SI(0)_{ij}$ stands for the pixel ij's luminance of the first subframe/subimage (0), which has been normalized to a gray value. to stands for the on-duration of the main switch S1 for the first and highest luminance factor L0. The factor $C_\text{EFF}(\text{Vold}_{ij})$ is the compensation factor against the drift of current efficiency at the operation point $\text{Voled}_{ij}$, and may be determined by an equation similar to Equation 32:

$$C_\text{EFF}(\text{Voled}_{ij})=C_\text{EFF}_{ij}\cdot[1+\text{EFF}(\text{Voled}_{ij},\text{STATE}_{ij})] \tag{38}$$

According to an exemplary embodiment, the simulation may be executed concurrently to the relatively long addressing time of the complete display and the following driving time to for $L_0$ (step 1012).

In an embodiment, since the compensation factors C_IV and C_EFF for every pixel of this subframe are known, the compensation factor CF_Total(0)ij may be calculated according to Equation 28 or Equation 33. Step 1013 stores these values so that, when the process of FIG. 10 is executed again for the next frame, these values may be used in step 1002 of the process of the next frame.

In step 1004, the first remaining image to be displayed, R(1), can be calculated. It may be derived by the subtraction:

$$R(1)=I-\text{SI}(0)=R(0)-\text{SI}(0) \tag{39}$$

In an embodiment, the source image I may be considered as the initial or 0-th remaining image (that is, R(0)). SI(0) is the simulated luminance distribution (subimage) for the first subframe B(0) and the results of the step 1003.

In step 1005, every gray level value of R(1) may be compared to $L_1*(1+CF_Total(1)_{ij})$ in order to obtain the binary matrix B(1). $L_1$ is the second highest luminance factor.

In step 1015, B(1) can be used for addressing and driving the AMOLED displays.

Such a procedure may be subsequently executed to get B(s) matrices for addressing and driving. At the same time, the corresponding subimages can be simulated and the next remaining image may be calculated. For example, the second subimage SI(1) can be simulated, then the second remaining image $R_2$ can be calculated:

$$R(2)=R(1)-\text{SI}(1) \tag{40}$$

In an embodiment, the binary matrices (B(s)) may successively be determined starting from the highest luminance factor ($L_0$) to the lowest, as well as the subimages SI(s) simulated/calculated. The compensation factors C_Total(s) may be calculated and stored.

In step 1006, the second last subimage SI(q−2) may be calculated and in step 1007 the last remaining image may be gained by subtraction.

Another result of step 1006 are the CF_Total(0)ij values. In step 1016, these values may be stored so that they may be used for the next frame.

In step 1008, the last binary subframe B(q−1) can be generated. According to an exemplary embodiment, this may again be accomplished by a compare function, as described. In step 1018, the last subframe B(q−1) can be addressed and driven.

In step 1009 the last subimage SI(q−1) may be calculated. Based on the subimage SI(q−1), the compensation factors C_Total(q−1) may be stored in step 1019, and may be used for the next frame.

After the last (q−1) subframe, in an embodiment, the missing luminance or luminance overshoot at each pixel may be less than one least significant bit (LSB) or less than half LSB gray value. Hence, the desired image may be reproduced exactly, with negligible to no changes in luminance, by the digital driving of the AMOLED display.

In step 1010 and the following steps, the next frame (image data) may be inputted, processed and driven according to the method starting from step 1001.

Since the resistance of the power supply, supply lines, the main switch, and other components ($R_{SUPPLY}$ in FIG. 1) are considered in the simulation, the duration for the luminance factor $L_S$ may be independent of the $n_{ACT}(s)$ number. The on-duration of the main switch $t_S$ may just depend on the $L_S$ value.

According to an exemplary embodiment, this method may be performed either taking the column/row resistance into account, or neglecting the column/row resistance, as desired. If the column/row resistance is considered, in an embodiment, considering the column/row resistance may require overall more complex logics and more memories than the method by neglecting the column/row resistance. An AMOLED display with negligible column/row resistance may consume less power and may allow a simpler algorithm for image decomposition, but may potentially offer other downsides, such as greater expense.

According to the description above, this exemplary embodiment can utilize a method to decompose a gray value image into a set binary subframes for driving an aged AMOLED display with non-negligible trace resistances, wherein I-V drift and drifted current efficiency are considered.

In some embodiments, the OLED aging model, the electronic measurement and the compensation algorithm may contain error or deviation. Nevertheless, the deviation can be significantly lower than that without compensation, so that artifacts like image sticking will get perceivable much later. Thus, the lifetime of an AMOLED display may be significantly extended by this process.

According to an exemplary embodiment, the use of digital driving may be particularly advantageous when used in combination with an algorithmic compensation method, since an accurate digital driving method may just require high temporal resolution in order to be implemented.

According to an exemplary embodiment, the 2T1C (2 transistors 1 capacitor) pixel circuit in FIG. 1 may also function as a basic pixel circuit for analog driving. Certain other differences may be present when OLED pixels are analog driven instead. For example, for analog driving, the power supply may not need to be switched and the OLED pixel current may flow continuously or nearly continuously. The data voltage may no longer be a two-level signal like with digital driving (which alternates between the states of low and high). The pixel circuit may instead work in an analog manner, operating through a range of voltage values. The pixel gray value may be converted by a DAC (digital analog converter) of the column driver to a voltage level, which may be applied to the column of the panel (DATA in FIG. 1). According to an exemplary embodiment, this voltage may be, for example, the gate source voltage of the driver transistor T1, and may be stored in the capacitor Cs. The transistor T1 may be operated in the saturation region and acts like a current source. It feeds the OLED with a certain current which correlates to the pixel gray value.

According to an exemplary embodiment, an OLED aging model may also be applied for analog driving. An analog-driven aging model may have several differences from a digitally-driven aging model. For example, the compensation factor C_IV may no longer be relevant, while a compensation factor against the drift of the current efficiency may still be needed. In order to calculate these values in an analog-driven case, one possible measurement method may be to, again, use pixel current measurement. In case of analog driving, a constant current may be injected into an OLED. Since the change of the voltage of an aged OLED is relatively low, the measurement of OLED voltage is not sensitive. If a constant voltage is applied to OLED, the relative change of the OLED current is much higher. Therefore, this means that conducting a pixel current measurement at a constant current may be less meaningful than conducting the pixel current measurement at a constant voltage.

In an exemplary embodiment wherein analog driving is used, the pixel circuit may act like a constant current source in the real operation of analog driving. So, in one exemplary embodiment, in order to perform a pixel current measurement, the pixel circuit may have to allow a connection of the OLED to a voltage source, in addition to the constant current mode for the display operation. In one embodiment, this may require operating the driver transistor as a switch. In an alternative embodiment, the pixel circuit may be extended, allowing a connection between OLED and an external voltage source. An aging model based on pixel current measurement may deliver a normalized current efficiency and thus a compensation factor.

A straight-forward method to compensate the drift of current efficiency is the application of Equation 30, provided again below for reference.

$$GV_COMP_{ij}=GV_{ij}+CF_Total_{ij}\cdot GV_{ij}$$

However, according to an exemplary embodiment wherein the OLED is analog-driven, in an equivalent equation for analog-driving, the compensation factor CF_Total may be replaced by C_EFF. The factor C_IV may be interpreted as zero for analog driving. However, there may be problems with directly using this equation for analog driving, and it may produce severe deviation. Since the operation for analog driving is wide, e.g. 3.0-4.0 volts, the current efficiency may vary significantly with the operation point, as FIG. 8 shows. Because of the wide range of voltages used, the variation may be significantly stronger than that with digital driving. Thus, determining how to properly perform compensation against the drift of current efficiency requires considering the operation point.

The control signal with analog driving is the current $I_GV_{ij}$ which may represent the gray value $GV_{ij}$ at a certain display brightness set (e.g. 300 nits). The objective luminance of the pixel may be given by Equation 41:

$$GV_{ij}\sim\eta_o\cdot I_GV_{ij} \tag{41}$$

Since the current efficiency η may decrease with operation time, the control current may be manipulated in order to suppress image sticking. The real luminance of the pixel may be generated by a compensated current I_Cij and should meet:

$$G_{ij}\sim\eta(I_C_{ij})\cdot I_C_{ij} \tag{42}$$

The current efficiency does depend on the operation point. For analog driving it may be reasonable to use the OLED current as the operation point instead of the OLED voltage Voled. As OLED is a two-terminal device, for every Voled there is an accordant Ioled and vice versa. The approach for an OLED aging model described in this invention may be applied. It particularly considers the dependence on the operation point.

Turning now to exemplary FIG. 11, FIG. 11 shows a plot of the normalized current efficiency of an exemplary OLED device at various aging states (from 46 h till 1737 h) for OLED currents of 0 to 1.2 mA. This data may be derived from the same exemplary test results as FIG. 8. As shown in FIG. 11, the current efficiency may strongly depend on Ioled, with relatively small changes in Ioled causing significant changes in the current efficiency, particularly when the currents are very low (that is, when the luminance/gray values are also relatively low).

According to an exemplary embodiment, in order to compensate for the drift of current efficiency, the OLED current should fulfill the relation of Equation 43:

$$\eta(I_C_{ij})\cdot I_C_{ij}=\eta_o\cdot I_GV_{ij} \tag{43}$$

The current efficiency at the current state is, based on Equation 32, the following value:

$$C_EFF(s)_{ij} = C_EFF_{ij}\cdot[1+EFF(n_{ACT}(s),\ STATE_{ij})] = \frac{\eta_o}{\eta(I_C_{ij})} - 1 \tag{44}$$

Rearranging equation 44 yields the following equation:

$$\frac{\eta_o}{\eta(I_C_{ij})} = 1 + C_EFF_{ij}\cdot[1+EFF2(I_C_{ij},\ STATE_{ij})] \tag{45}$$

Equation 45 may incorporate the function EFF2( ), which may have the OLED current as input instead of Voled or $n_{ACT}(s)$ but which is otherwise substantially equivalent to the function EFF( ). By combining Equation 43 and Equation 45, the manipulated pixel current for compensation against the drift of current efficiency at analog driving mode may be:

$$I_C_{ij}=I_GV_{ij}+C_EFF_{ij}\cdot[1+EFF2(I_C_{ij},STATE_{ij})]\cdot I_GV_{ij} \tag{46}$$

Equation 46, above, is an implicit function. If the I_GVij value is inserted in the RHS of Equation 46 and replaces the term I_Cij, a straightforward calculation is possible. However, the result may contain too much deviation.

There are several methods to reasonably determine the I_Cij value. According to an exemplary embodiment, one solution may be to insert the I_Cij value from the last frame in the RHS of Equation 46. In such an embodiment, the I_Cij values of the last frame may be stored.

In another embodiment, an iterative approach may be taken. In the RHS of Equation 46, the first value for I_Cij may be approximated as:

$$I_C_{ij}=I_GV_{ij}+C_EFF_{ij}\cdot I_GV_{ij} \tag{47}$$

Equation 47 may yield a new I_Cij value, which may itself be inserted in the RHS of Equation 46, and used to calculate another value of I_Cij. The new I_Cij value may be inserted again. After a defined number (e.g. 8) of iterations, a reasonable value for I_Cij may be obtained.

In another embodiment, a search algorithm, like binary search, may be used. Equation 46 may be transformed to:

$$I_GV_{ij}=I_C_{ij}-C_EFF_{ij}\cdot[1+EFF2(I_C_{ij},STATE_{ij})]\cdot I_GV_{ij} \tag{48}$$

In such an embodiment, a value for I_Cij may be given an initial middle value (e.g. 512 for 10 bits), and may be varied from that initial middle value. If the RHS is smaller than I_GVij, the I_Cij value may be increased. If the RHS is greater than I_GVij, the I_Cij value may be reduced. The step for a change of I_Cij may successively be halved (for example, in a case wherein the right-hand side of the equation is consistently greater than I_GVij, I_Cij may first be set to 512, then 256, 128, etc.). After a few steps, for instance 10 steps for 10 bits, the control signal I_Cij may be available.

In another embodiment, the manipulated pixel current may be determined by setting up a new LUT based on Equation 46.

$$I_C_{ij}=Ana_Comp(I_GV_{ij},C_EFF_{ij},STATE_{ij}) \tag{49}$$

Equation 49 may be simplified, if C_EFFij is used as the only aging state parameter. This may yield the following equation:

$$I_C_{ij}=Ana_Comp(I_GV_{ij},C_EFF_{ij}) \tag{50}$$

In an exemplary embodiment, the construction of such an LUT may be based on implicit Equation 46, Equation 49 or Equation 50, and may be executed in a computer. The result may be the LUT Ana_Comp( ). It is worth mentioning that the ratio between $I_C_{ij}$ and $I_GV_{ij}$ is for a given gray value not constant, but depends on the operation point (the absolute value of $I_C_{ij}$ or $I_GV_{ij}$) because the EEF2( ) function in Equation 48 depends on the absolute value of $I_C_{ij}$. For example, there may be two different ratios for the same pixel gray value at two different brightness configurations of the display (e.g. 300 nits and 200 nits), if the pixel is aged.

The pre-determined LUT may be read in the real-time processing (compensation against the drift of current efficiency). In an exemplary embodiment, the operation point of the analog driven OLED may be considered in the compensation.

According to an exemplary embodiment, since the human eye may be sensitive to even a relatively low percentage range of luminance difference at low luminance, the value of I_Cij may need to be accurate and may be resolved by more bits than the original gray value. In order to meet the I_Cij value and to achieve certain accuracy for the compensation, a higher resolution for the DAC of the column driver may be used.

To summarize, according to an exemplary embodiment, an OLED aging model which is based on electrical measurements and stating the relative change of current efficiency in dependence of the operation point may allow compensation of artifacts like image sticking on AMOLED displays. It may be implemented in a digital driving scheme or in an analog driving scheme. This way, the lifetime of AMOLED displays may significantly be enhanced and the application windows enlarged.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A method for driving an active matrix organic light-emitting diode (AMOLED) display, the AMOLED display comprising a plurality of organic light-emitting diodes (OLEDs) arranged in a plurality of rows and a plurality of columns; a plurality of pixel circuits each configured to drive an OLED, and arranged in a plurality of rows and a plurality of columns;

a scan line for selecting the pixel circuits of each row of pixel circuits and a data line for controlling the pixel circuits of each column of pixel circuits; and a plurality of supply lines connected to the anodes and cathodes of the AMOLED pixels; the method comprising:

calculating, with a processor, an individual compensation factor against at least one of the drift of an IV-characteristic and the drift of a current efficiency of one or more OLED pixels based on a data counting model;

adjusting, based on the compensation factor of the one or more OLED pixels, one or more pixel gray values of the one or more OLED pixels, wherein the adjustment of the one or more pixel gray values further depends on an operation point of an OLED in the OLED pixel; and applying a data signal to the pixel circuit based on the adjusted pixel gray value; wherein the adjusted pixel gray value of the OLED pixel is generated based on the amplitude of the current fed to the pixel circuit, and wherein, if the individual compensation factor is calculated against the drift of a current efficiency, dependence of a relative current efficiency decrease on the operation point of the OLED is considered in calculating the compensation factor.

2. The method of claim 1, wherein temperature is considered in the data counting model or the temperature is considered in the accumulated stress used for the data counting model.

3. The method of claim 1, wherein brightness of the display is considered in the data counting model or brightness of the display is considered in the accumulated stress used for the data counting model.

4. The method of claim 1, wherein the data counting model is calculated and applied in real time operation.

5. The method of claim 1, wherein the adjusted pixel gray values are determined by an iterative procedure with at least one loop.

6. The method of claim 1, wherein the adjusted pixel gray values are determined by a search procedure.

7. The method of claim 1, wherein the adjusted pixel gray values are determined by referencing a lookup table including a dependence of a relative current efficiency decrease on the operation point of the OLED.

8. The method of claim 1, wherein the adjusted pixel gray values have a higher resolution than the original gray values of the one or more OLED pixels.

9. A method for driving an active matrix organic light-emitting diode (AMOLED) display, the AMOLED display comprising a plurality of organic light-emitting diodes (OLEDs) arranged in a plurality of rows and a plurality of columns; a plurality of pixel circuits each configured to drive an OLED, and arranged in a plurality of rows and a plurality of columns; a scan line for selecting the pixel circuits of each row of pixel circuits and a data line for controlling the pixel circuits of each column of pixel circuits; and a plurality of supply lines connected to the anodes and cathodes of the AMOLED pixels; the method comprising:

measuring, with an electronic unit, at least one electrical property of one or more OLEDs, each of the one or more OLEDs being a component of an OLED pixel, each of the OLED pixels having a current efficiency value;

calculating, with a processor, an individual compensation factor against at least one of the drift of an IV-characteristic and the drift of a current efficiency of one or more OLED pixels based on the electrical properties measured or a combination of electrical properties measured and a data counting model;

adjusting, based on the compensation factor of the one or more OLED pixels, one or more pixel gray values of the one or more OLED pixels, wherein the adjustment of the one or more pixel gray values further depends on an operation point of an OLED in the OLED pixel; and applying a data signal to the pixel circuit based on the adjusted pixel gray value; and wherein the adjusted pixel gray value of the OLED pixel is generated based on the amplitude of the current fed to the pixel circuit, wherein, if the individual compensation factor is calculated against the drift of a current efficiency, dependence of a relative current efficiency decrease on the operation point of the OLED is considered in calculating the compensation factor.

10. The method of claim 9, further comprising measuring, with the electronic unit, at least one electrical property of one or more OLEDs when the AMOLED display is in a passive state.

11. The method of claim 9, wherein a pixel current measurement is taken of an OLED receiving a constant voltage.

12. The method of claim 9, wherein the adjusted pixel gray values are determined by an iterative procedure with at least one loop.

13. The method of claim 9, wherein the adjusted pixel gray values are determined by a search procedure.

14. The method of claim 9, wherein the adjusted pixel gray values are determined by referencing a lookup table including a dependence of a relative current efficiency decrease on the operation point of the OLED.

15. The method of claim 9, wherein the adjusted pixel gray values have a higher resolution than the original gray values of the one or more OLED pixels.

16. The method of claim 9, wherein the compensation factor is calculated such that the data counting model on an OLED is more influential in calculating the compensation factor when the accumulated stress is low, and less influential in calculating the compensation factor when the accumulated stress is high.

17. The method of claim 9, wherein the data counting model is applied to examine consistency of an aging model and/or an electrical measurement at a strongly aged state.

* * * * *